US012782065B2

(12) United States Patent
Chehade et al.

(10) Patent No.: US 12,782,065 B2
(45) Date of Patent: Nov. 3, 2026

(54) DRY COOLER ASSEMBLY AND METHOD OF ASSEMBLING THEREOF

(71) Applicant: OVH, Roubaix (FR)

(72) Inventors: Ali Chehade, Moncheaux (FR); Gregory Francis Louis Bauchart, Wattrelos (FR)

(73) Assignee: OVH, Roubaix (FR)

( * ) Notice: Subject to any disclaimer, the term of this patent is extended or adjusted under 35 U.S.C. 154(b) by 111 days.

(21) Appl. No.: 18/792,329

(22) Filed: Aug. 1, 2024

(65) Prior Publication Data

US 2025/0052522 A1 Feb. 13, 2025

(30) Foreign Application Priority Data

Aug. 9, 2023 (EP) ..... 23306358

(51) Int. Cl.
*F28F 9/00* (2006.01)
*E04B 1/58* (2006.01)
(Continued)

(52) U.S. Cl.
CPC ..... *F28F 9/002* (2013.01); *F28F 9/0075* (2013.01); *E04B 1/585* (2013.01);
(Continued)

(58) Field of Classification Search
CPC ..... F28C 1/14; F28B 1/02; H05K 7/20145; H05K 7/20163; F28F 9/0132; E04B 1/585; E04B 2001/5875
See application file for complete search history.

(56) References Cited

U.S. PATENT DOCUMENTS 7,937,963 B1 5/2011 Semmes
2007/0155236 A1* 7/2007 Shi ..... H02G 3/32 439/587
(Continued)

FOREIGN PATENT DOCUMENTS

CA 2809418 A1 9/2014
IT 201900018293 A1 4/2021
(Continued)

OTHER PUBLICATIONS

Translation of WO2017082714A1 named Translation-WO2017082714A1 (Year: 2017).*
(Continued)

*Primary Examiner* — Paul Alvare
(74) *Attorney, Agent, or Firm* — BCF LLP

(57) ABSTRACT

A kit and a method for a dry cooler assembly is provided. The kit includes a first frame and a second frame, each being configured to support a heat exchanger. The kit further includes a base component and a roof component. The frames, the base component, and the roof component are configured to be assembled to an assembled configuration, such that the base component supports the frames in a spaced apart configuration, and the frames support the roof component. The method includes securing the base component to a surface, obtaining the first frame and the second frame, each frame being configured to support the heat exchanger, and positioning the frames such that they abut an abutment member of the base component such that the frames are supported in a spaced apart configuration.

12 Claims, 18 Drawing Sheets

(51) Int. Cl.

| | |
|---|---|
| ***F28B 1/02*** | (2006.01) |
| ***F28C 1/14*** | (2006.01) |
| ***F28F 9/007*** | (2006.01) |
| ***F28F 9/013*** | (2006.01) |

(52) U.S. Cl.
CPC ..... *E04B 2001/5875* (2013.01); *F28B 1/02* (2013.01); *F28C 1/14* (2013.01); *F28F 9/0132* (2013.01)

(56) References Cited

U.S. PATENT DOCUMENTS

| | | | | |
|---|---|---|---|---|
| 2008/0060790 | A1* | 3/2008 | Yates | F16F 7/14 361/679.48 |
| 2019/0310020 | A1* | 10/2019 | Klaba | F28B 1/06 |
| 2020/0321762 | A1* | 10/2020 | de Almeida | H02G 3/32 |
| 2020/0378695 | A1* | 12/2020 | Chehade | F28D 1/0443 |
| 2021/0062817 | A1* | 3/2021 | Bauduin | F04D 29/522 |

FOREIGN PATENT DOCUMENTS

| | | | | |
|---|---|---|---|---|
| RU | 2794742 | C1 * | 4/2023 | |
| TW | M564065 | U * | 7/2018 | |
| WO | 99/64794 | A1 | 12/1999 | |
| WO | WO-2017082714 | A1 * | 5/2017 | F28F 27/00 |

OTHER PUBLICATIONS

Translation of TWM564065U named Translation-TWM564065U (Year: 2018).*

Translation of RU2794742C1 named Translation-RU2794742C1 (Year: 2023).*

European Search Report to the counterpart EP Patent Application No. 23306358.5 completed on Feb. 9, 2024.

* cited by examiner

DRY COOLER ASSEMBLY AND METHOD OF ASSEMBLING THEREOF

CROSS REFERENCE

The present application claims priority to EP application N° 23306358.5 entitled "DRY COOLER ASSEMBLY AND METHOD OF ASSEMBLING THEREOF", filed Aug. 9, 2023, the entirety of which is incorporated herein by reference.

FIELD OF TECHNOLOGY

The present technology generally relates to heat exchanger assemblies such as dry cooler assemblies.

BACKGROUND

Datacenters store an extensive amount of heat-generating electronic equipment. To regulate and evacuate heat generated by the electronic equipment, datacenters typically implement a sizable heat management system, such as dry cooler assemblies.

Dry cooler assemblies typically include heat exchangers and fans to cool heated fluid from the datacenter. Specifically, heated fluid (e.g., heated water) is received by the heat exchangers of the dry cooler assembly where the fluid transfers heat to ambient air, pulled in by the fans, thereby cooling the fluid. The heated air is then discharged and the now cooled fluid is recirculated back to the datacenter.

Dry cooler assemblies are typically large and heavy which places limitations on transportation and installation. Some dry cooler assemblies may be shipped in shipping containers to the datacenter. Due to the size and weight, a shipment of a dry cooler assembly usually results in a large shipping cost as well as a large carbon footprint. Furthermore, during installation, additional steps are required to provide adequate support due to the size and weight of the dry cooler assembly. For example, complicated concrete foundations are poured prior to installation.

Thus, there is a desire for a dry cooler assembly which overcomes at least some of the abovementioned problems.

SUMMARY

According to one aspect of the present technology, there is provided a kit for a dry cooler assembly, the kit includes a first frame and a second frame, each of the first and the second frames being configured to support a heat exchanger and having a body portion and a lower portion, the body portion having an inner side. The kit further includes a base component and a roof component. The first and the second frames, the base component, and the roof component are configured to be assembled to an assembled configuration, such that the base component supports the first and the second frames in a spaced apart configuration, and the first and the second frames support the roof component.

In some embodiments, the base component comprises a first base member and a second base member, each of the first and second base members include an elongate body having a channel defined therein, the channel being defined by channel walls, the channel configured to receive the respective lower portion of each of the first and the second frames.

In some embodiments, the lower portion comprises a first foot and a second foot, spaced apart from each other and extending away from the inner side of the body portion.

In some embodiments, the channel of each of the first and second base members is configured to receive: one of the first foot and the second foot of the first frame and the other of the first foot and the second foot of the second frame such that the inner sides of the first and second frames face one another in the assembled configuration.

In some embodiments, at least one of the channel walls has a flared upper portion.

In some embodiments, the flared upper portion is at an end region of the elongate body.

In some embodiments, the flared upper portion is angled outwardly between 30 to 60 degrees relative to the channel walls.

In some embodiments, the lower portion includes a support member, and the channel walls further include a recessed portion for receiving the support member, the support member extending in a different direction to the first foot and the second foot.

In some embodiments, the elongate body further includes an abutment member configured such that at least one of the first foot and the second foot abuts the abutment member in the assembled configuration.

In some embodiments, the abutment member is centrally disposed in the channel.

In some embodiments, the abutment member includes a rectangular cross-sectional profile taken orthogonal to a longitudinal plane of the abutment member.

In some embodiments, the kit further includes a cable and piping management system, the cable and piping management system having: an insert positionable between the first and second frames and shaped to create a tunnel between the respective inner sides of the first and second frames.

In some embodiments, the cable and piping management system further includes a loop wire arrangement connectable to at least one of the base component, the first frame and the second frame.

In some embodiments, the kit further includes at least one air-to-liquid heat exchanger housed in the body portion of at least one of the first frame and the second frame.

In some embodiments, the roof component includes a roof panel having a fan.

In some embodiments, the kit further includes at least one cooling pad and at least one reservoir housed in at least one of the first frame and the second frame.

In some embodiments, the first and the second frames include a receiving portion configured to receive a fork of a forklift.

In some embodiments, the kit further includes a shipping container housing the first and the second frames, the base component and the roof component, the first and the second frames, the base component and the roof component forming one set of the dry cooler assembly.

In some embodiments, within the shipping container, the roof component is disposed in between the first and the second frames.

In some embodiments, the roof component is configured to be removably coupled to at least one of the first and the second frames when positioned in the shipping container housing.

In some embodiments, the roof component includes at least one opening configured to align with at least one opening on at least one of the first and the second frame. The roof component being removably coupled to at least one of the first and the second frame via insertion of at least one fastener extending through the aligned openings of the roof component and at least one of the first and the second frame.

In some embodiments, the shipping container houses a plurality of the sets of the dry cooler assembly.

In some embodiments, the roof component is sized to be substantially similar to the first and the second vertical frames.

According to one aspect of the present technology, there is provided a method for assembling a dry cooler assembly, the method includes-securing a base component to a surface, obtaining a first frame and a second frame, each of the first and the second frames being configured to support a heat exchanger, and positioning the first frame and the second frame such that they abut an abutment member of the base component such that the first and the second frame are supported in a spaced apart configuration.

In some embodiments, positioning the first frame and the second frame includes orienting the first frame and the second frame to the base component such that a longitudinal axis of the base component is substantially transverse to a respective longitudinal axis of the first frame and the second frame.

In some embodiments, securing the base support to the surface includes securing a first base member to the surface and securing a second base member to the surface, such that the first base member and the second base member are substantially parallel to one another.

In some embodiments, positioning the first frame includes: disposing a first foot of the first frame into a channel defined by channel walls of the first base member, disposing a second foot of the first frame into a channel defined by channel walls of the second base member, disposing a first foot of the second frame into the channel of the first base member, and disposing a second foot of the second frame into the channel of the second base member.

In some embodiments, disposing the first foot or the second foot into the respective channel of the first member or the second member includes guiding the first foot or the second foot by a flared upper portion of the respective channel wall.

In some embodiments, disposing the first foot or the second foot into the respective channel of the first member or the second member includes abutting an end of the respective first foot or the second foot against the abutment member of the respective first and second base members.

In some embodiments, abutting the end of the respective first foot or the second foot against the abutment member of the respective first and second base members includes abutting the end of the respective first foot or the second foot against the abutment member disposed centrally within the channel of the respective first and second base members.

In some embodiments, the method further includes disposing a cable and piping management system between the first and second frames, the cable and piping management system configured to support one or both of liquid circuitry and electrical circuitry.

In some embodiments, the method further includes inserting one or both of liquid circuitry or electrical circuitry within the cable management system, wherein the liquid circuity and electrical circuitry are configured to support one or more dry cooler assemblies.

In some embodiments, the method further includes positioning a roof component onto the first frame and the second frame, such that the first and second frames support the roof component.

According to one aspect of the present technology, there is provided a base member for a dry cooler assembly, the base member including an elongate body having a channel defined therein, the channel being defined by channel walls with at least one flared upper portion.

In some embodiments, at least one flared upper portion is at an end region of the elongate body.

In some embodiments, there are two flared upper portions, one at each end region of the elongate body.

In some embodiments, the elongate body further includes an abutment member positioned between the two flared upper portions.

In some embodiments, the channel walls further include a recessed portion.

In some embodiments, the base member further includes a cable and piping management system which is a loop wire arrangement connectable to the base member.

In the context of the present specification, unless expressly provided otherwise, the words "first", "second", "third", etc. have been used as adjectives only for the purpose of allowing for distinction between the nouns that they modify from one another, and not for the purpose of describing any particular relationship between those nouns.

It must be noted that, as used in this specification and the appended claims, the singular form "a", "an" and "the" include plural referents unless the context clearly dictates otherwise.

As used herein, the term "about" in the context of a given value or range refers to a value or range that is within 20%, preferably within 10%, and more preferably within 5% of the given value or range.

As used herein, the term "and/or" is to be taken as specific disclosure of each of the two specified features or components with or without the other. For example "A and/or B" is to be taken as specific disclosure of each of (i) A, (ii) B and (iii) A and B, just as if each is set out individually herein.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of embodiments of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

It should be noted that, unless otherwise explicitly specified herein, the drawings are not to scale.

DETAILED DESCRIPTION

The examples and conditional language recited herein are principally intended to aid the reader in understanding the principles of the present technology and not to limit its scope to such specifically recited examples and conditions. It will be appreciated that those skilled in the art may devise various arrangements that, although not explicitly described or shown herein, nonetheless embody the principles of the present technology.

Furthermore, as an aid to understanding, the following description may describe relatively simplified implementations of the present technology. As persons skilled in the art would understand, various implementations of the present technology may be of a greater complexity.

In some cases, what are believed to be helpful examples of modifications to the present technology may also be set forth. This is done merely as an aid to understanding, and, again, not to define the scope or set forth the bounds of the present technology. These modifications are not an exhaustive list, and a person skilled in the art may make other modifications while nonetheless remain within the scope of the present technology. Further, where not examples of modifications have been set forth, it should not be interpreted that no modifications are possible and/or that what is described is the sole manner of implementing that element of the present technology.

Moreover, all statements herein reciting principles, aspects, and implementations of the present technology, as well as specific examples thereof, are intended to encompass both structural and functional equivalents thereof, whether they are currently known or developed in the future.

With these fundamental principles in place, we will now consider some non-limiting examples to illustrate various implementations of aspects of the present disclosure.

From a broad aspect, there is provided a dry cooler assembly 10 which is modular and can be assembled to an assembled configuration for use thereof, and which can be disassembled to a disassembled configuration, such as for shipment and storage.

Figure 1:
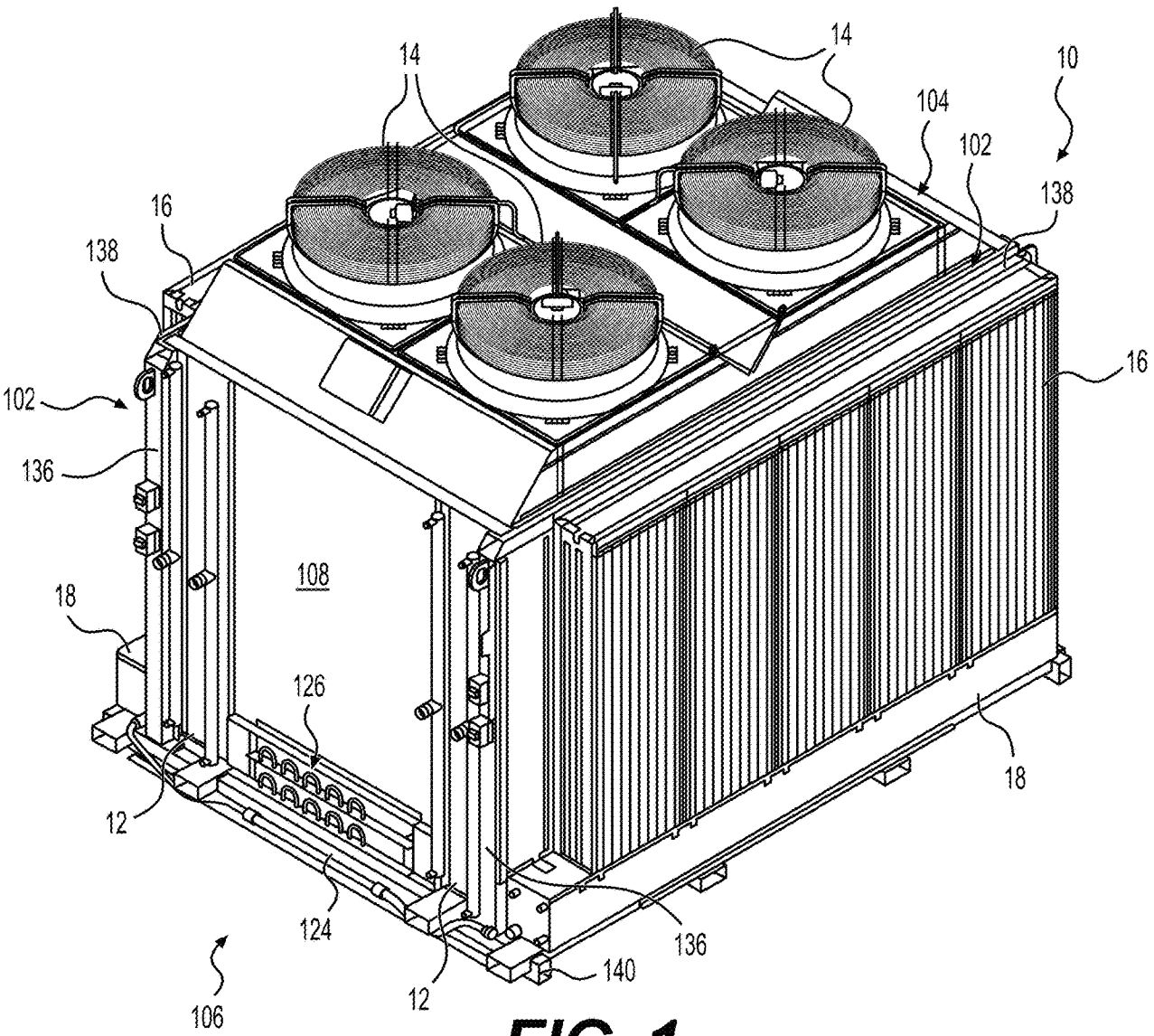
FIG. 1 is a perspective view, taken from the front, left side of a dry cooler assembly in an assembled configuration, according to embodiments of the present technology.

With reference to FIG. 1, the dry cooler assembly 10 is depicted in the assembled configuration. The dry cooler assembly 10 includes at least one heat exchanger 12 (such as an air-to-liquid heat exchanger) configured to receive heated fluid (e.g., water) from a heat source such as heat-generating components of a datacenter. The dry cooler assembly 10 further includes at least one fan 14 configured to pull ambient air into the dry cooler assembly 10. The cool ambient air moves through the at least one heat exchanger 12 and heat is transferred from the heated fluid to the cool ambient air. The now heated ambient air is expelled from the dry cooler assembly 10 via the fan 14 and the cooled fluid is returned to the datacenter and the process is repeated. It is contemplated that the dry cooler assembly 10 may optionally include at least one cooling pad 16 and a reservoir 18. The cooling pad 16 and the reservoir 18 are disposed on an exterior face of the heat exchanger 12. The reservoir 18 contains a cooling fluid (e.g., water) that is dispensed across the cooling pad 16, providing a cool surface. The ambient air is pulled through the cool surface of the cooling pad 16, thereby cooling the ambient air prior to contact with the heat exchanger 12.

As depicted in FIG. 1, the dry cooler assembly 10 includes two heat exchangers 12 positioned upright and oppositely facing each other in a spaced apart configuration. The dry cooler assembly 10 further includes two cooling pads 16 and two reservoirs 18. Each of the two cooling pads 16 are positioned on an externally facing side of the heat exchangers 12, such that ambient air flows through the cooling pads 16 prior to flowing through the heat exchangers 12. Each of the two reservoirs 18 are disposed beneath respective cooling pads 16. The two reservoirs 18 dispense a fluid across a surface of their respective cooling pads 16. In certain embodiments, the dispensed fluid is received by the reservoir 18 and recycled, forming a closed feedback loop. In certain embodiments, the cooling pad 16 and reservoir 18 may be omitted. In some embodiments, the closed feedback loop may include a filter and a pump to convey the recycled dispensed fluid.

Figure 2:
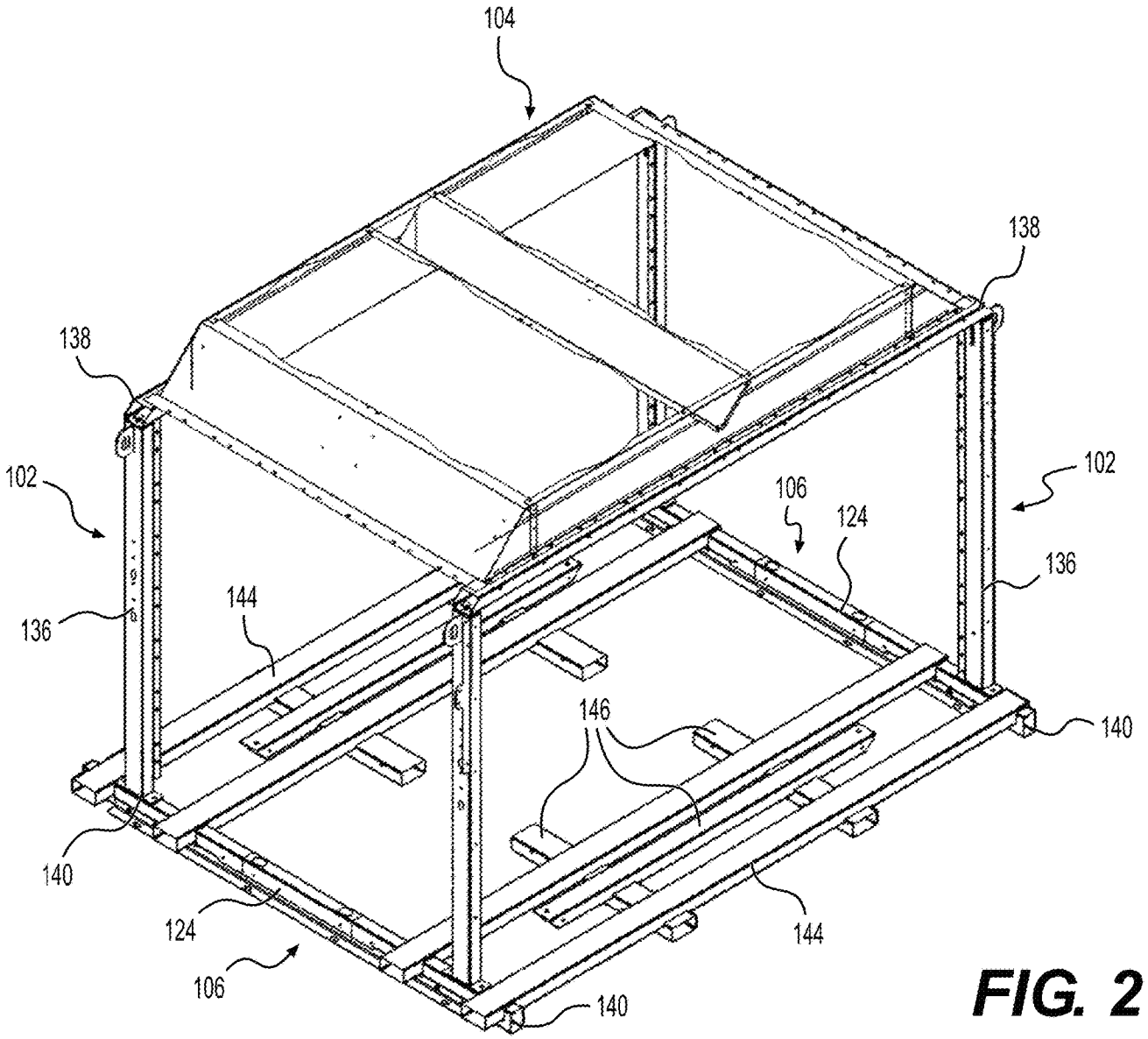
FIG. 2 is a perspective view, taken from the front, left side of the dry cooler assembly of FIG. 1, with the heat exchangers, the cooling pads, the reservoirs, and the fans removed.

As best seen in FIG. 2, the heat exchangers 12, the cooling pads 16, and the reservoirs 18 are supported by respective frames 102. Each frame 102 has two substantially upright portions 136 spaced apart from each other and connected by a substantially horizontal portion 138. In some embodiments, each frame 102 is configured to house the heat exchanger 12 between the two substantially upright portions 136. In some embodiments, the heat exchangers 12 are removably connected to an inner side of the respective frame 102. The cooling pads 16 and reservoirs 18 are removably connected to an outer side of the respective frame 102. In other words, each frame 102 is sandwiched between the heat exchanger 12 and the cooling pad 16 and the reservoir 18. In other embodiments, each frame 102 may support a respective heat exchanger 12 in any other manner. The frames 102 will be described in further detail below.

With specific reference to FIG. 2, there is further provided at least one base component for supporting the frames 102 of the dry cooler assembly 10. The base component comprises two base members 106. In use, each base member 106 is configured to be secured to a support surface, such as a floor, a concrete slab, or a metallic pad, on which the dry cooler assembly 10 will be assembled. In the assembled configuration of the dry cooler assembly 10, the base members 106 are positioned spaced apart and parallel to one another. Each frame 102 is connected to a respective end of both base members 106 so that, when assembled, the heat exchangers 12 are positioned orthogonally to the base members 106. One end of each of the base members 106 receives a portion of one of the frames 102 and the opposing end of the base member 106 receives a portion of the other frame 102. The substantially upright portions 136 of the frames 102 extend upwardly, orthogonal to the base members 106. The dry cooler assembly 10 when assembled is substantially cuboidal in configuration, with the substantially upright portions 136 of the frames 102 defining four edges. The base members 106 will be described in further detail below.

The dry cooler assembly 10 further includes a roof component 104 removably connected to a top portion of each of the frames 102 and extending therebetween. It can be said that the roof component 104 is supported by the frames 102. In alternative implementations, the dry cooler assembly 10 includes a mounting structure (e.g. a frame) operatively connected to the roof component 104, the frames 102 and the base members 106. In this alternative implementations, the roof component 104 is thus supported by the mounting structure instead of the frames 102. The roof component 104 houses fans 14. The fans 14 are configured to pull ambient air from outside the dry cooler assembly 10, through the cooling pads 16 where the ambient air is cooled, and into the heat exchanger 12. The ambient air is warmed as it moves through the heat exchanger 12 and, eventually, expelled from the dry cooler assembly 10 via the fans 14. Although the roof component 104 is depicted as housing four fans 14, the number of fans 14 is not particularly limited and the roof component 104 may support any number of fans. The roof component will be described in further detail below.

The dry cooler assembly 10 may further include at least one end panel 108. In certain embodiments, the dry cooler assembly 10 includes two end panels 108 disposed one at either end of the dry cooler assembly 10 (one of which is depicted in FIG. 1). Each end panel 108 is removably connected to, and extends laterally between, the two frames 102. Each end panel 108 is removably connected to, and extends vertically between, one of the base members 106. In the assembled configuration, each end panel 108 is orthogonal to the heat exchangers 12.

The frames 102, the base member 106, the roof component 104, and optionally the end panels 108 are detachably attachable together and may be considered as the modules of the dry cooler assembly 10. As previously described, the modular nature of the dry cooler assembly 10 allows the dry cooler assembly 10 to be configurable in the assembled configuration (depicted in FIG. 1) and the disassembled configuration (depicted in FIG. 3). The dry cooler assembly 10 in the disassembled configuration may be considered as a kit of parts of the dry cooler assembly 10.

Figure 3:
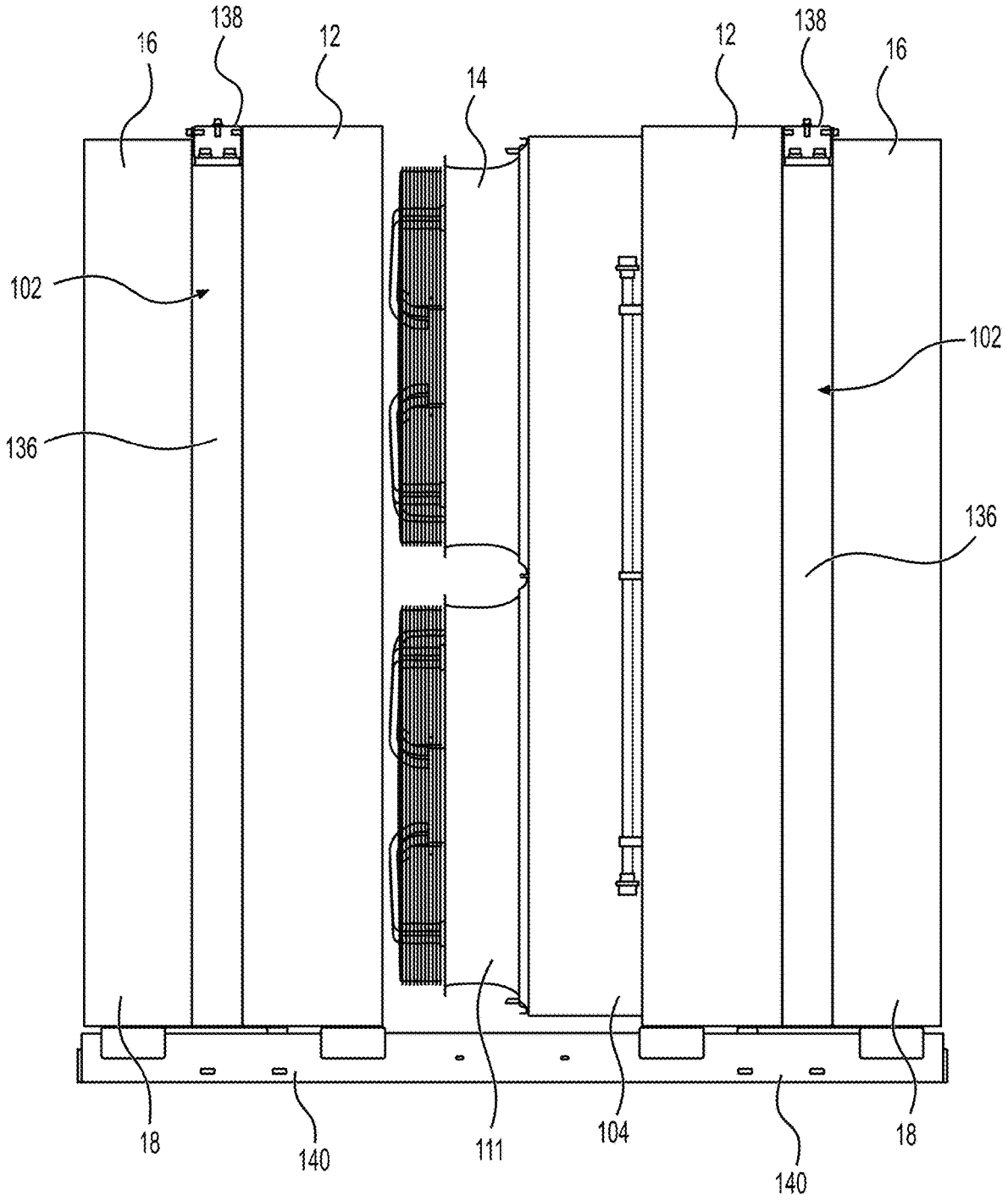
FIG. 3 is a front plan view of the dry cooler assembly of FIG. 1 in a disassembled configuration, according to embodiments of the present technology.

With reference to FIGS. 3, the disassembled configuration will now be described in detail. In the disassembled configuration of the dry cooler assembly 10, each of the frame 102, base member 106 and the roof component 104 are detached and separated from one another. Each frame 102 has the respective heat exchanger 12, the cooling pad 16, and the reservoir 18 removably connected thereto. The roof component 104 includes the fans 14 attached thereto.

A packing of the individual components of the dry cooler assembly 10 in the disassembled configuration, may provide certain space saving efficiencies. The frames 102 (including the heat exchangers 12, the cooling pads 16, and the reservoirs 18) are positioned upright and opposing one another. The frames 102 are positioned such that the heat exchangers 12 face inwardly and towards each other. The roof component 104 (including the fans 14) is disposed in between the two frames 102 and also in an upright position. In some embodiments, the roof component 104 is removably coupled to one or more of the frames 102, such as by one or more fasteners (e.g. screws or bolts) extending through aligned openings in each of the frames 102 and the roof component 104. In the disassembled configuration, the reservoirs 18 are empty and may be used to house the base members 106. In some embodiments, each reservoir 18 may house one base member 106. Alternatively, one of the reservoirs 18 may house both base members 106. The end panels 108 may be slotted in between the roof component 104 and the opposing frame 102, that is, the frame 102 the roof component 104 is not secured to (not shown). By means of this arrangement, a packing efficiency may be obtained by reducing or minimizing space between the different components. In certain embodiments, the dry cooler assembly 10 in the disassembled configuration is sized and shaped to be housed in a shipping container.

It is appreciated that the arrangement of the disassembled configuration described above is exemplary and alternative arrangements of the components of the dry cooler assembly 10 are possible. For example, in an alternative embodiment, the roof component 104 may be removably connected to one of the heat exchangers 12. In a further alternative embodiment, the roof component 104 may be disposed on one of the outer sides of the frame 102. That is, the roof component 104 may be removably coupled to one of the cooling pads 16 and associated reservoir 18. Additionally, it is contemplated that, in another embodiment, the base members 106 may be removably connected to any one of, or a combination of, the frames 102, the heat exchangers 12, the cooling pads 16, the reservoirs 18, and the roof component 104. In a further alternative embodiment, the end panels 106 may be configured to be removably connected to any one of, or a combination of, the frames 102, the heat exchangers 12, the cooling pads 16, the reservoirs 18, and the roof component 104. It is further contemplated that an alternative means of removably connecting respective components may be used, for example using ropes or winch straps to secure components together.

The modular nature of the dry cooler assembly 10 permits the different components to be packed closer together, thereby reducing a footprint of the packed dry cooler assembly 10 in the disassembled configuration. In other words, the footprint of the dry cooler assembly 10 in the disassembled configuration is smaller compared to the footprint of dry cooler assembly 10 in the assembled configuration. Such a reduced footprint in the disassembled configuration can improve storage efficiency and capacity within a storage facility. Additionally, the reduced footprint can allow for multiple dry cooler assemblies 10 to be housed and shipped in a single shipping container 200, reducing the number of shipments required, ultimately reducing shipping costs and reducing the carbon footprint associated with the shipments of the dry cooler assemblies 10.

Figure 4:
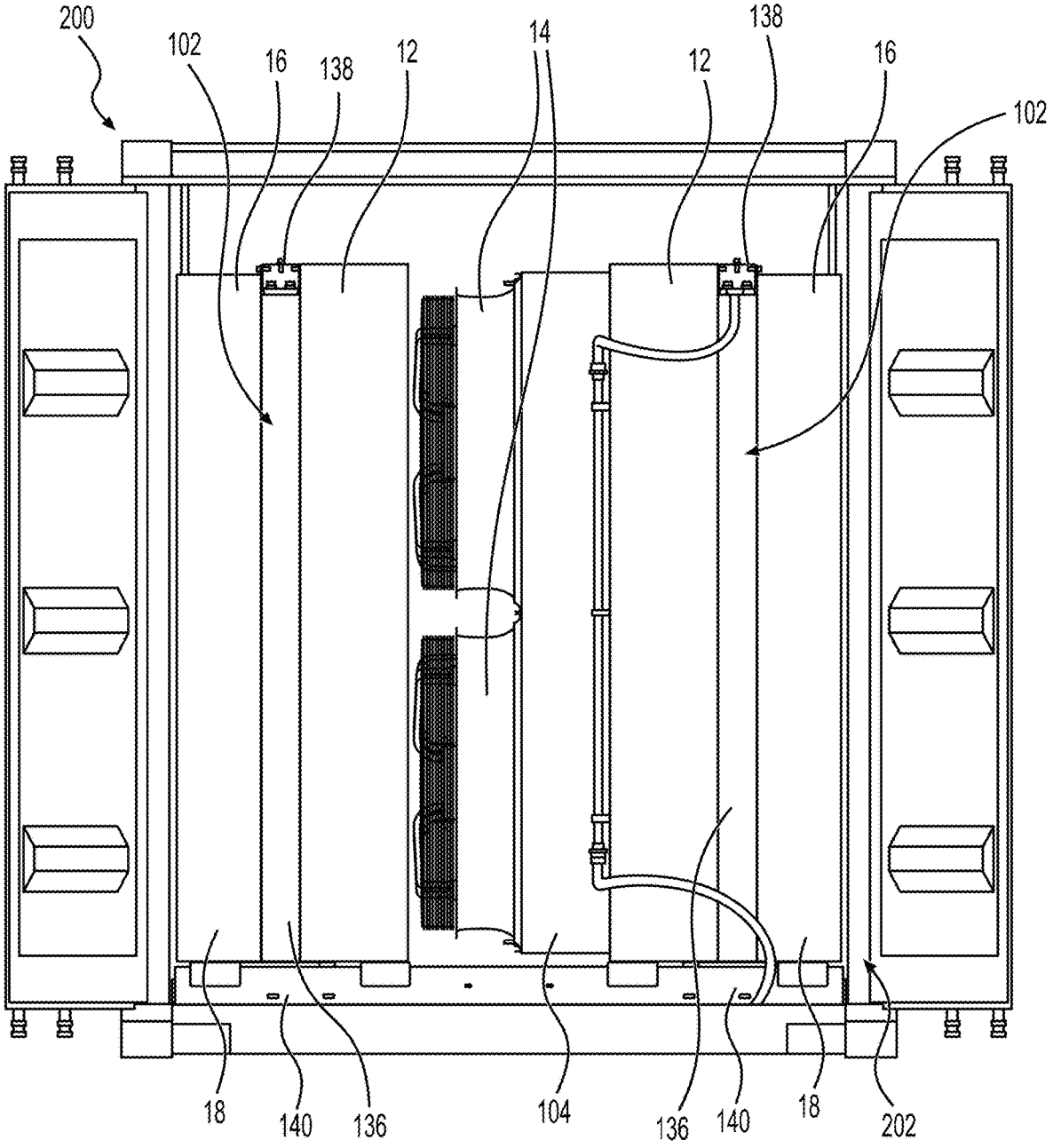
FIG. 4 is a front plan view of the dry cooler assembly of FIG. 3 disposed within a shipping container, according to embodiments of the present technology.

With reference to FIG. 4, the dry cooler assembly 10 in the disassembled configuration is shown housed within a shipping container housing 200. In certain embodiments, the disassembled configuration of the dry cooler assembly 10 is sized to fit within the shipping container 200. That is, a height of the disassembled configuration is less than an interior height of the shipping container 200 and a width of the disassembled configuration is less than an interior width of the shipping container 200. In a specific example, the height of the disassembled dry cooler assembly 10 may be between 2.0 m to 2.5 m, such as 2.3 m, and the width of the disassembled dry cooler assembly 10 may be between 2.0 m to 2.5 m, such as 2.1 m.

Figure 5:
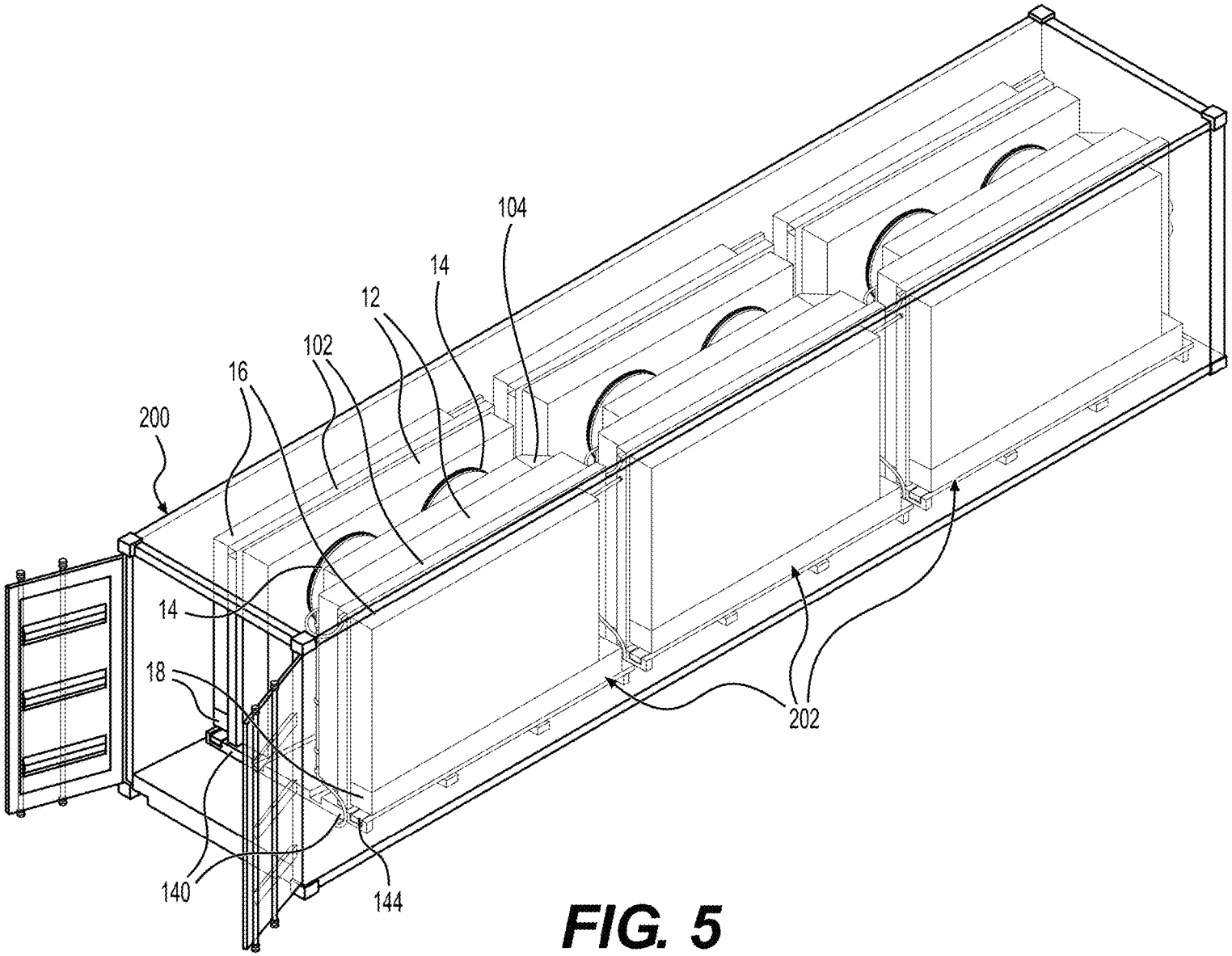
FIG. 5 is a perspective view, taken from the front, left side, of the shipping container of FIG. 4 including three sets of the dry cooler assembly of FIG. 3, according to embodiments of the present technology.

In some embodiments, a length of the disassembled configuration of the dry cooler assembly 10 allows for multiple disassembled dry cooler assemblies 10 to be housed within a single shipping container 200. In a specific example, the length of the disassembled dry cooler assembly 10 may be between 3.0 m and 4.0 m, such as 3.6 m. As depicted in FIG. 5, the shipping container 200 houses three sets 202 of disassembled dry cooler assemblies 10 disposed along a length of the shipping container 200. The sets 202 of disassembled dry cooler assemblies 10 are longitudinally aligned in the shipping container 200. Each disassembled dry cooler assembly 10 is removably secured to an interior portion of the shipping container 200. For example, the shipping container 200 may include slots configured to receive and secure a portion of the frames 102. Alternatively, ropes or winch straps may be used to secure various components of the dry cooler assembly 10 to components (e.g., hooks or loops) disposed within the shipping container 200.

With reference to FIGS. 6 to 16, the components of the dry cooler assembly 10 will now be described in detail. As previously described, the dry cooler assembly 10 includes the roof component 104 (including the fans 14) disposed above and extending between the two frames 102 (with each frame 102 supporting one heat exchanger 12, one cooling pad 16, and one reservoir 18). Each frame 102 is supported by two base members 106 which are secured to the support surface.

Figure 6:
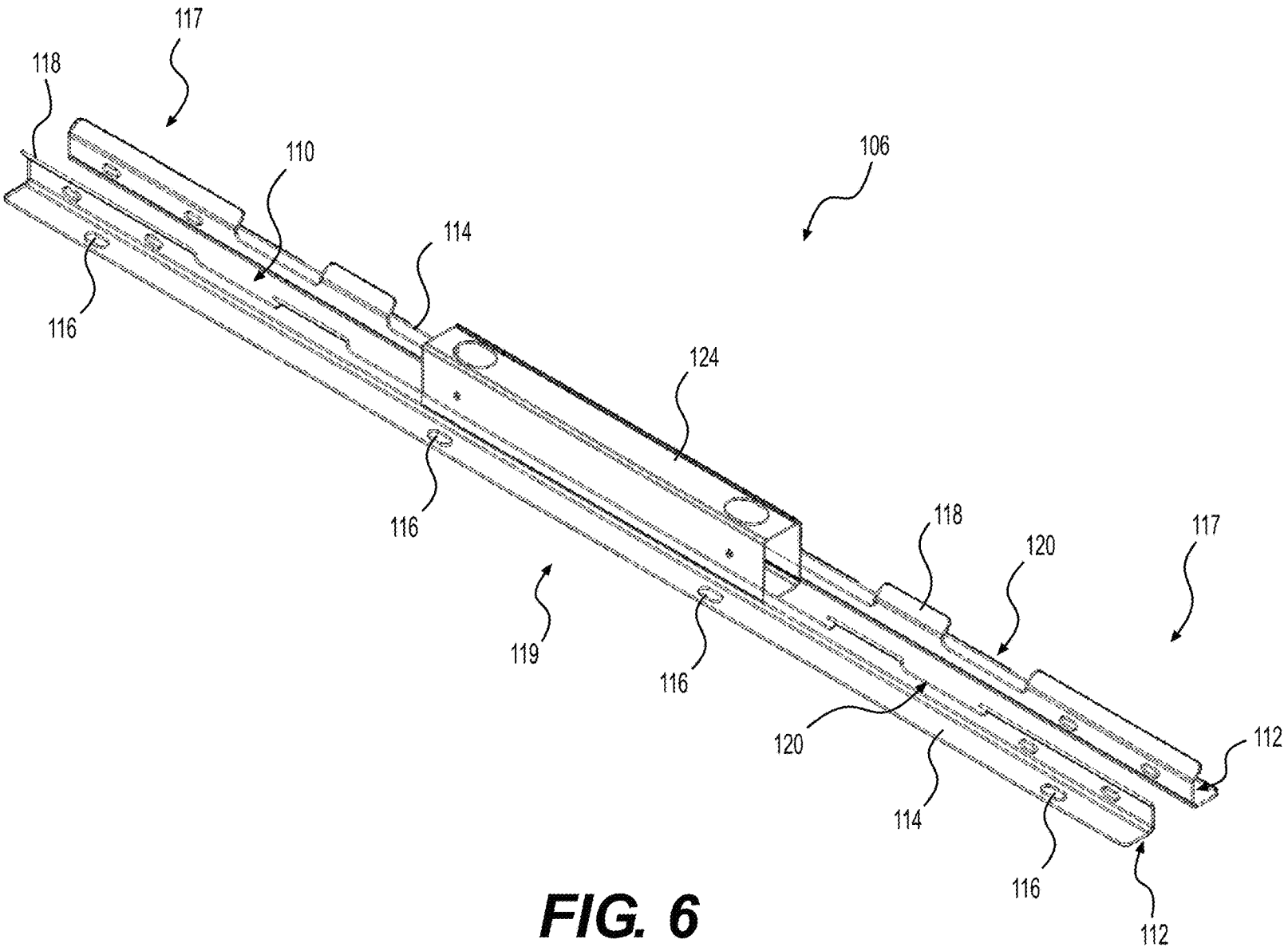
FIG. 6 is a perspective view, taken from the front, left side of a base member of the dry cooler assembly of FIG. 1, according to embodiments of the present technology.
Figure 7:
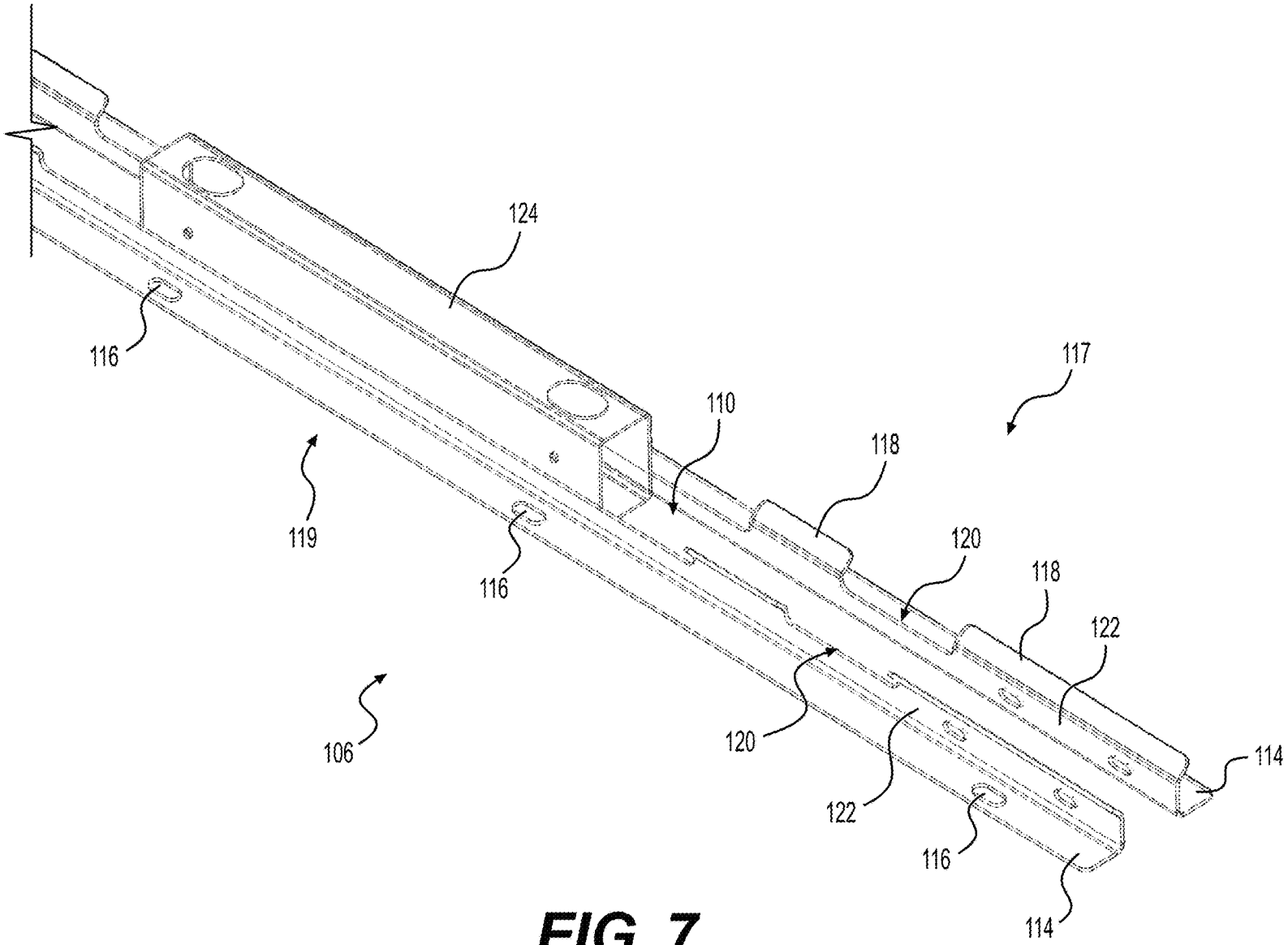
FIG. 7 is an enlarged perspective view, taken from the front, left side of the base member of FIG. 6.
Figure 8:
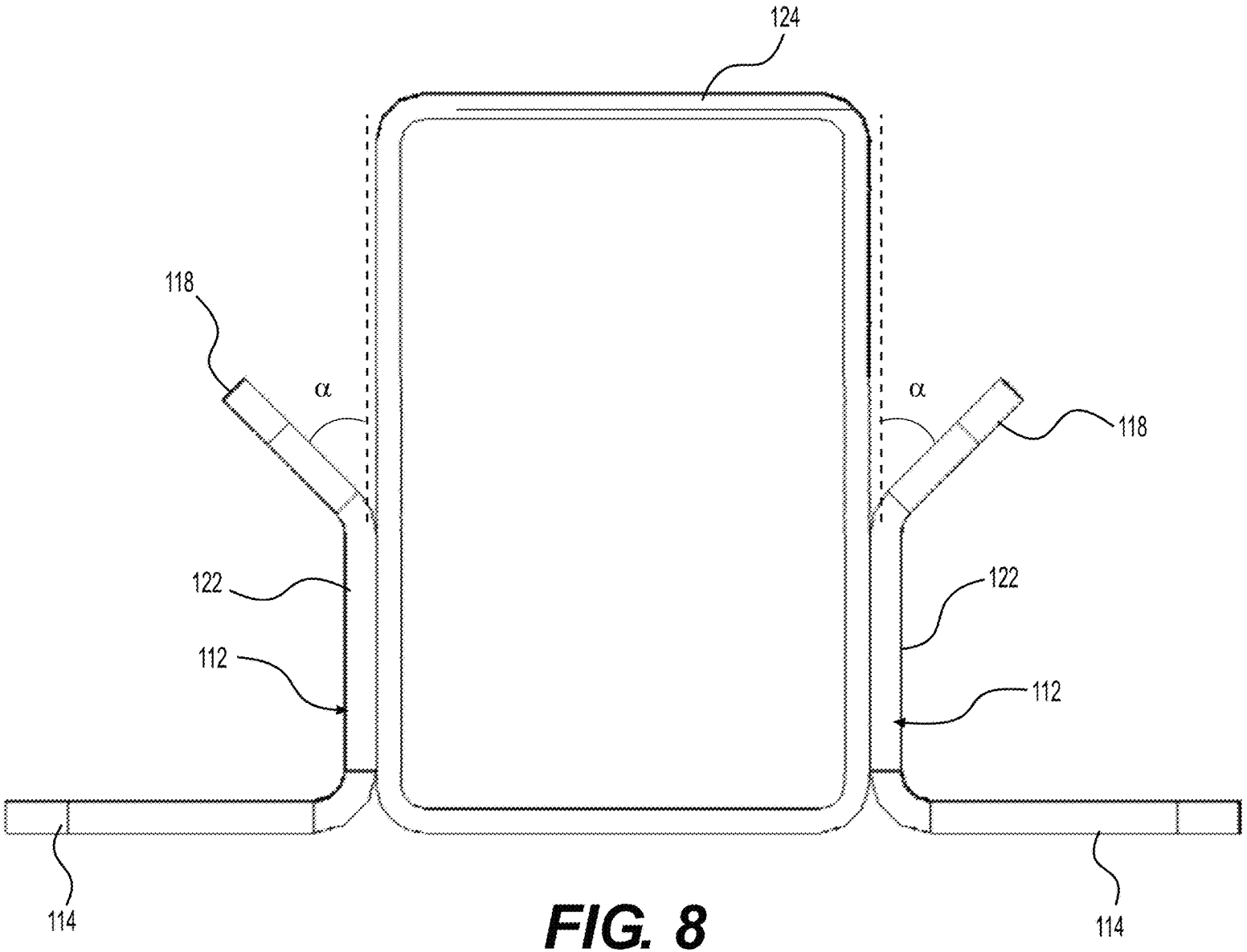
FIG. 8 is a left plan view of the base member of FIG. 6.

Referring to FIGS. 6 to 8, the base members 106 will now be described in detail. The two base members 106 are identical to one another and thus, reference hereinbelow will broadly be made to the base member 106. The base member 106 comprises an elongate body having a channel 110 defined therein and extending longitudinally along the length of the base member 106. The channel 110 is defined by channel walls 112 and is configured to receive a lower portion 139 of each of the frames 102 (which will be described below) when in the assembled configuration. The channel 110 has an open top and an open bottom. As such a bottom face of the frames 102 contacts, in use, the support surface. The weight of the frames 102 (including the heat exchangers 12, cooling pads 16, and reservoirs 18) are thus supported by the support surface itself. In certain embodiments, the channel walls 112 of the base member 106 form at least a portion of side walls 122 of the base member 106.

Each side wall 122 of the base member 106 is L-shaped and provides a bottom face 114 of the base member 106 which will contact the support surface. The bottom face 114 is orthogonal to the channel walls 112. Openings 116 are provided in the bottom face 114 of the base member 106 for receiving fasteners, such as screws or bolts, therethrough to connect the base member 106 to the support surface. The bottom face 114 and openings 116 of the base member 106 may simplify the installation of the dry cooler assembly 10, for example by removing the need for forming complicated concrete structures to secure the dry cooler assembly 10 to the support surface.

The channel walls 112 have at least one flared upper portion 118 configured to guide the lower portion 139 of the frame 102 into the channel 110 during installation. Referring to FIGS. 6 and 7, the flared upper portions 118 extend from an upper portion of each of the channel walls 112. The flared upper portions 118 are angled outwardly, away from each other and the channel 110. In some embodiments, the flared upper portions 118 are angled outwardly between 30° and 60° relative to the channel walls 112 (indicated by $\alpha$ in FIG. 8). In some embodiments, the flared upper portion 118 may extend to be 40% to 100% of a length of the lower portion 139 of the frame 102 received by the channel 110 (specifically, the feet 140 which will be described in further detail below). The flared upper portions 118 are disposed at end regions 117 of the elongate body of the base member 106. In other embodiments, instead of both channel walls 112 having the flared upper portions 118, the flared upper portion 118 may be provided on only of the channel walls 112.

Figure 14:
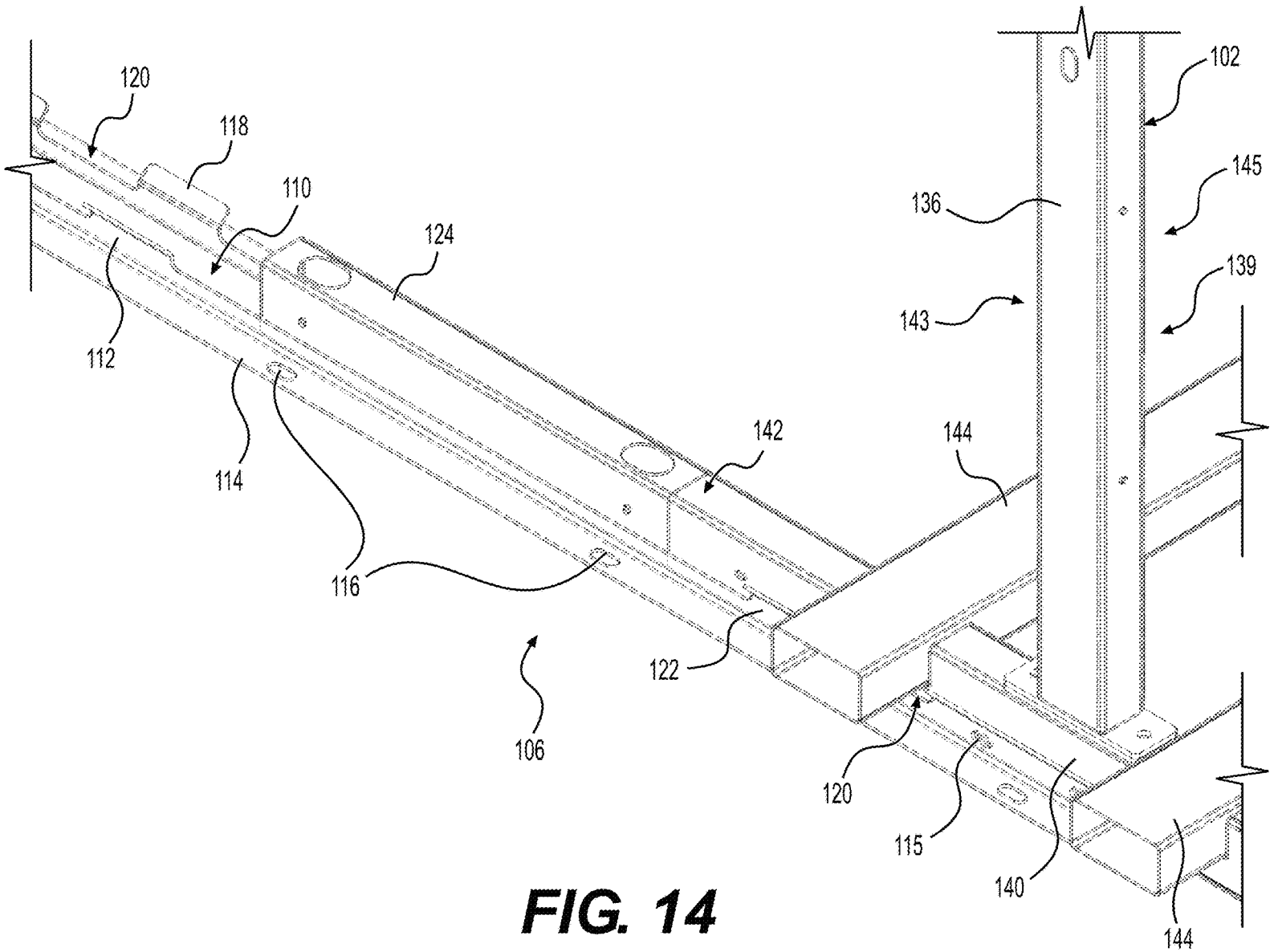
FIG. 14 is an enlarged perspective view, taken from the front, left side of the frame and the base member of the dry cooler assembly of FIG. 2.

As best seen in FIGS. 6 and 14, the flared upper portion 118 does not extend continuously along the end regions 117 of the base member 106. There is provided at least one recessed portion 120 for receiving the lower portion 139 of the frame 102 in the assembled configuration (which will be described in detail below). With reference to FIG. 6, the base member 106 includes two recessed portions 120 disposed at either end region 117 of the base member 106. The recessed portions 120 may be defined within one or more of the channel walls 112 and/or one or more of the flared upper portions 118.

Figure 9:
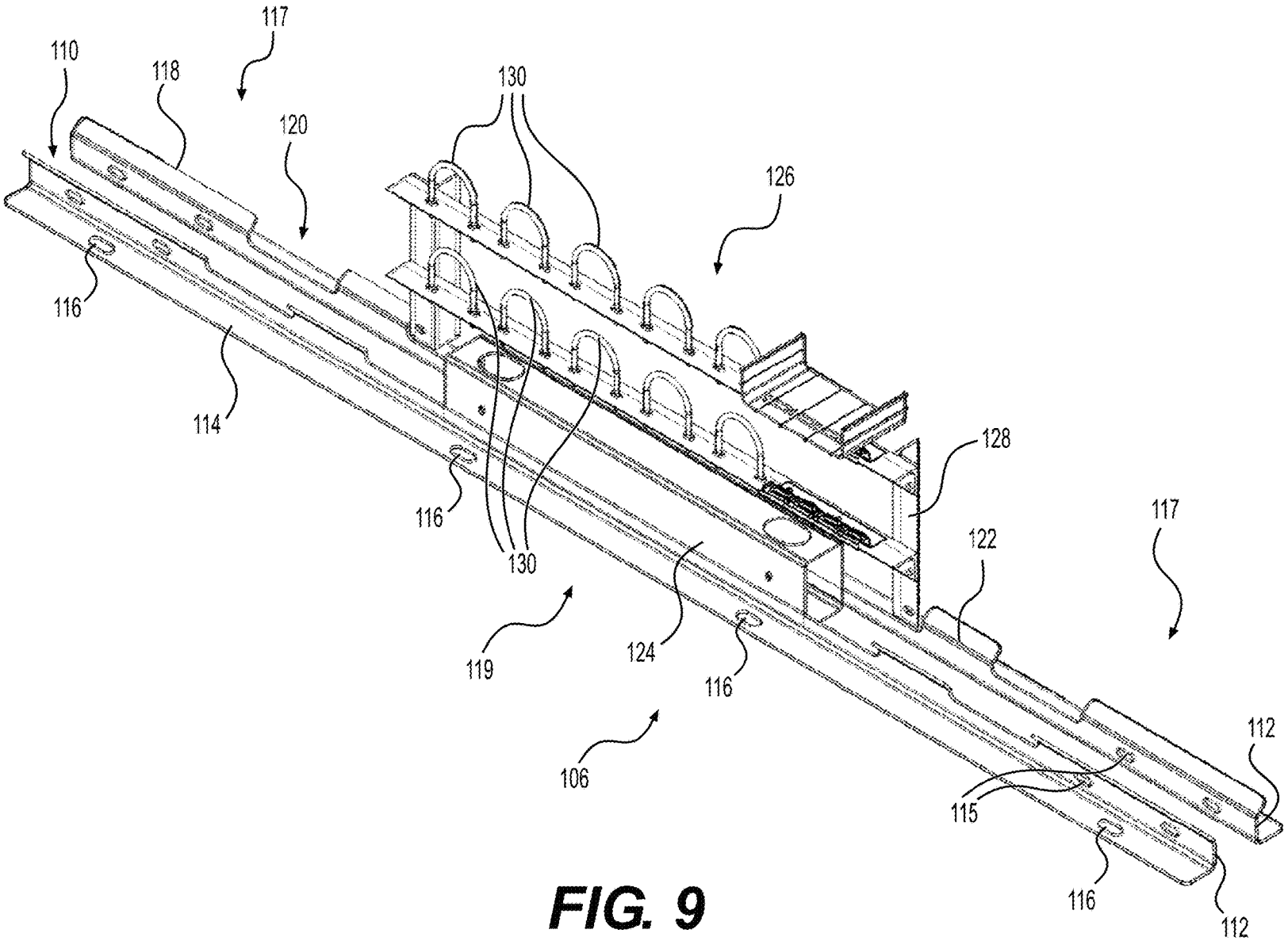
FIG. 9 is a perspective view, taken from the front, left side of the base member of FIG. 6 and including a cable and piping management system, according to embodiments of the present technology.
Figure 10:
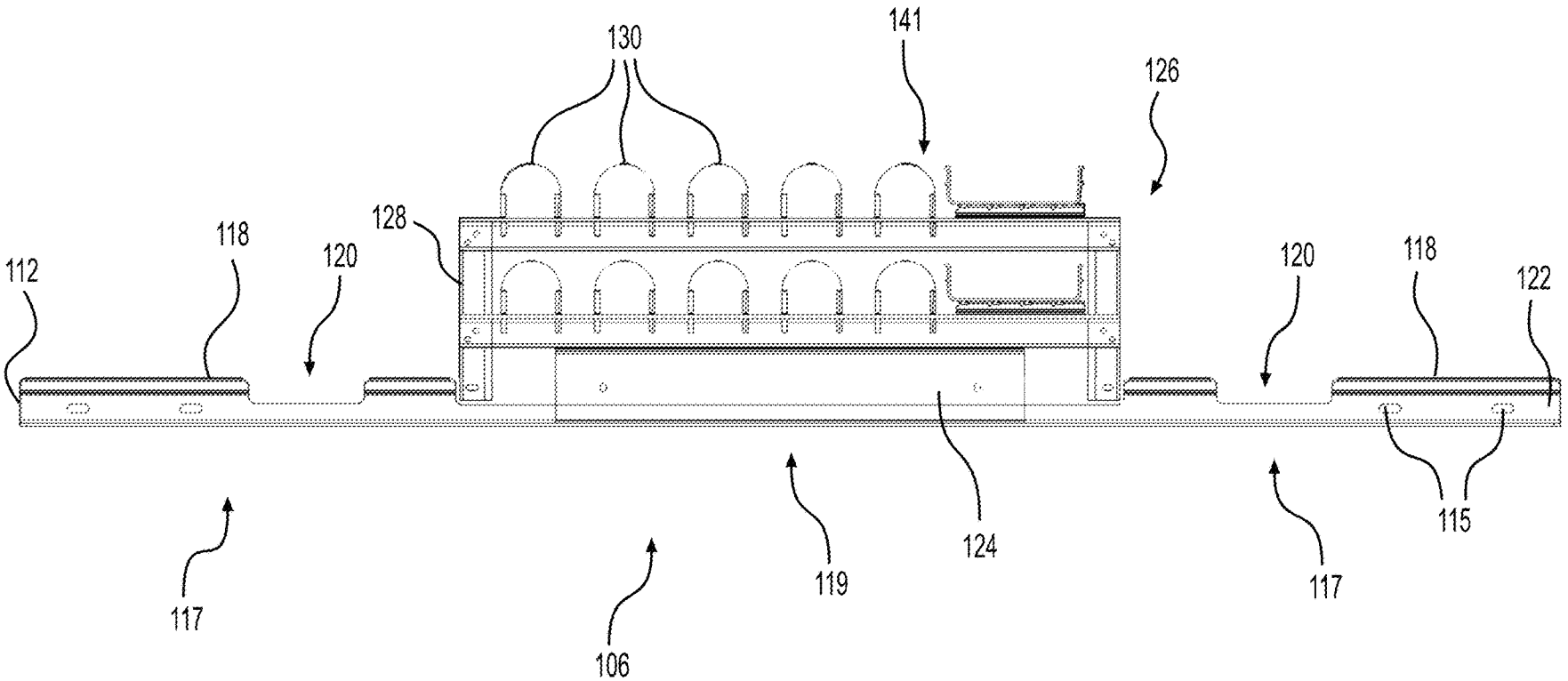
FIG. 10 is a front plan view of the base member and the cable and piping management system of FIG. 9.

As depicted in FIGS. 6, 9, and 10, the elongate body of the base member 106 further includes at least one abutment member 124 positioned at a central region 119 of the base member 106. The abutment member 124 contacts an end of the lower portion of the frame 102 when it is received in the channel 110 (as best seen in FIG. 14). The abutment member 124 thereby helps to position the two frames 102 at a pre-determined distance from one another when the frames 102 are connected to the base members 106. In other words, the abutment member 124 can function as a spacer for positioning the two frames 102. In certain embodiments, the abutment member 124 is sized to be disposed within the channel 110. The abutment member 124 is centrally disposed in the channel 110. The abutment member 124 is cuboidal and has a rectangular profile when viewed in cross-section orthogonally to a longitudinal axis of the abutment member 124. It is contemplated the abutment member 124 may include other geometries. For example, the abutment member 124 may have a trapezoidal cross-sectional profile. In certain embodiments, the abutment member 124 may be formed integrally with the base member 106, or be formed separately and connected thereto.

It is appreciated that a configuration of the base member 106 may differ from that described herein and depicted in the figures. For example, in an alternative embodiment, the channel 110 may have a closed bottom and an open top.

It is contemplated that the channel 110 may have a different geometry. For example, in an alternative embodiment, the channel 110 may be pawn-shaped, v-shaped, or any other appropriate geometry to allow for the interlocking of the complementary-shaped lower portion 139 of the frame 102.

It is contemplated that the base member 106 may include any number of flared upper portions 118. For example, in an alternative embodiment, the base member 106 may include a single flared upper portion 118 that extends the entire length of the channel walls 112. In another embodiment, the flared upper portions 118 may originate at a bottom portion of the channel walls 112. For example, the flared upper portions 118 may originate at the bottom edge of the channel walls 112.

It is further contemplated that the base member 106 may include multiple abutment members 124 which may be disposed at different locations along the channel 110. For example, the base member 106 may include two abutment members 124 with each abutment member 124 disposed at an end region of each of the flared upper portions 118. In a further alternative embodiment, the abutment member 124 may be configured to be positioned above the channel 110 rather than within the channel 110. In another embodiment, the abutment member 124 may be omitted.

In an alternative embodiment, the base member 106 may include any number of recessed portions 120. Furthermore, in an alternative embodiment, the recessed portions 120 may extend downwards the entire height of the channel walls 112, terminating at the bottom edge of the channel walls 112.

With reference to FIGS. 9 and 10, the dry cooler assembly 10 includes at least one cable and piping management system 141. The cable and piping management system 141 includes a loop wire arrangement 126 connectable to the base member 106 and configured to receive electrical and liquid circuitry. In certain embodiments, the loop wire arrangement 126 includes a fixture 128 with a plurality of loops 130 mounted to the fixture 128 for receiving electrical circuitry and/or liquid circuitry. In this non-limitative embodiment, the loop wire arrangement 126 includes two-levels of loops 130 distributed longitudinally along the fixture 128. In use, each loop 130 may circle and secure an electric bus, an electric wire, a pipe or any other component of electrical circuitry and/or liquid circuitry to the fixture 128. The fixture 128 may be formed integrally with the base member 106, or may be formed separately and may be connected to the base member 106 by any means such as via welding, adhesive, bolts, or screws, or a combination thereof. In some embodiments, the fixture 128 is connected to one of the channel walls 112 of the base member 106. Alternatively, the fixture 128 may be connected to the bottom face 114 of the base member 106. The loop wire arrangement 126 extends longitudinally along the base member 106 and is positioned at the central region 119 of the base member 106 (FIG. 10). However, it is contemplated that the loop wire arrangement 126 may be disposed anywhere along the base member 106. It should be appreciated that one or both base members 106 may include the loop wire arrangement 126. It is further contemplated that the loop wire arrangement 126 may be disposed on either of the frames 102.

Figure 11:
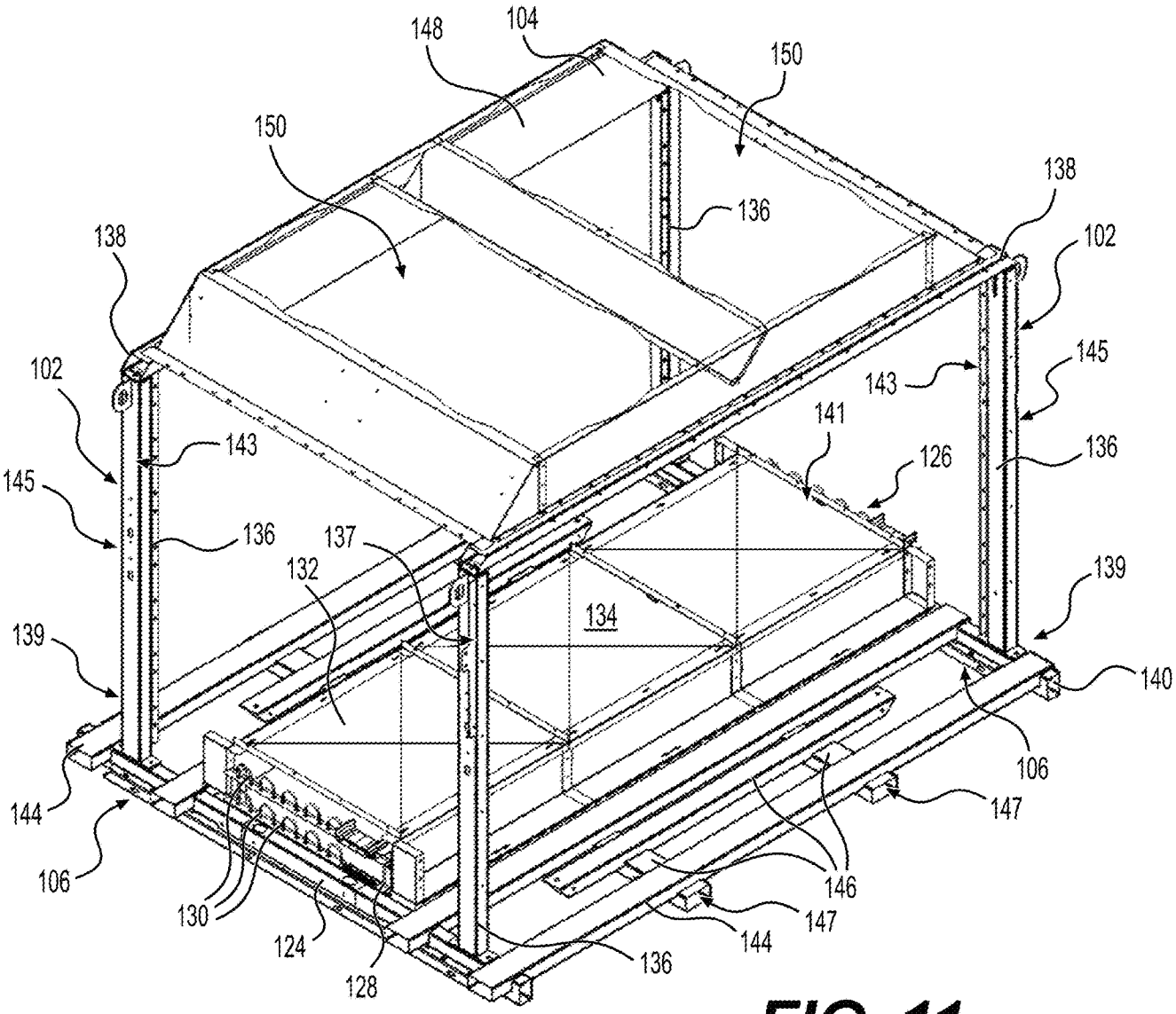
FIG. 11 is a perspective view, taken from the front, left side of the dry cooler assembly of FIG. 2 and including the cable and piping management system of FIG. 9 and an insert.
Figure 12:
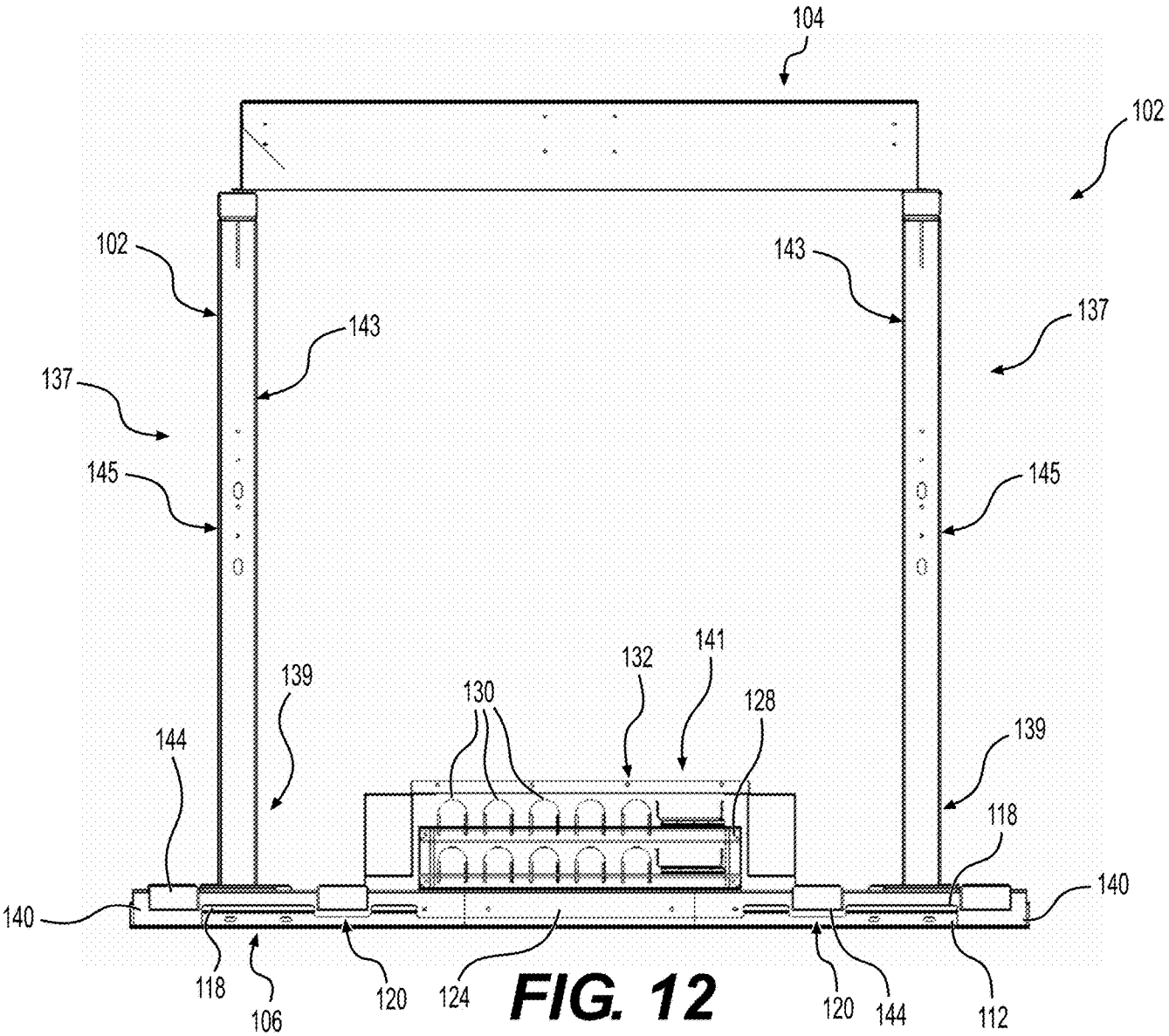
FIG. 12 is a front plan view of the dry cooler assembly of FIG. 11.

Referring to FIGS. 11 and 12, in certain embodiments, the cable and piping management system 141 further includes an insert 132 positionable between the inner sides 143 of the two frames 102, and forming a tunnel for receiving the electrical and/or liquid circuitry. In the assembled configuration, the tunnel is defined by the insert 132 and the support surface on which the dry cooler assembly 10 is supported. The insert 132 extends the entire distance between the two base members 106, with an outer surface 134 of the insert 132 acting as a floor of the assembled dry cooler assembly 10. In an alternative embodiment, the insert 132 may not extend the entire space between the base members 106. Instead, the insert 132 may only cover a portion, forming a partial floor of the assembled dry cooler assembly 10.

Although the cable and piping management system 141 has been described to include both the loop wire arrangement 126 and the insert 132, it is appreciated that the cable and piping management system 141 may include just the loop wire arrangement 126 or just the insert 132. Further, the cable and piping management system 141 of the assembled dry cooler assembly 10 may be configured to receive additional electrical and/or liquid circuitry. That is to say, the cable and piping management system 141 may be configured to receive electrical and/or liquid circuitry from additional dry cooler assemblies 10, thereby allowing for easy installation of additional dry cooler assemblies 10 back to back.

Referring to FIGS. 11 to 14, the frames 102 will now be described in detail. The two frames 102 are similar (mirror images of one another when assembled) and thus, reference hereinbelow will broadly be made to the frame 102. The frame 102 includes a body portion 137 for supporting the heat exchanger 12, the cooling pad 16, and the reservoir 18. The body portion 137 is formed by two upwardly extending arms 136 and a laterally extending arm 138. The laterally extending arm 138 connects an upper portion of each of the upwardly extending arms 136. As previously described, the frame 102 is sandwiched between the heat exchanger 12 and the cooling pad 16 and the reservoir 18 (in both the assembled and disassembled configurations). More specifically, the upwardly extending arms 136 and the laterally extending arm 138 are sandwiched between the heat exchanger 120 and the cooling pad 16 and the reservoir 18 (as seen in FIGS. 1, 3, and 4).

It is contemplated that the frame 102 may include any number of upwardly extending arms 136 and laterally extending arms 138. For example, in an alternative embodiment, the frame 102 may include an additional upwardly extending arm disposed centrally and an additional laterally extending arm connecting the lower portions of the frame 102, to further support the heat exchanger 12, the cooling pad 16, and the reservoir 18.

Figure 13:
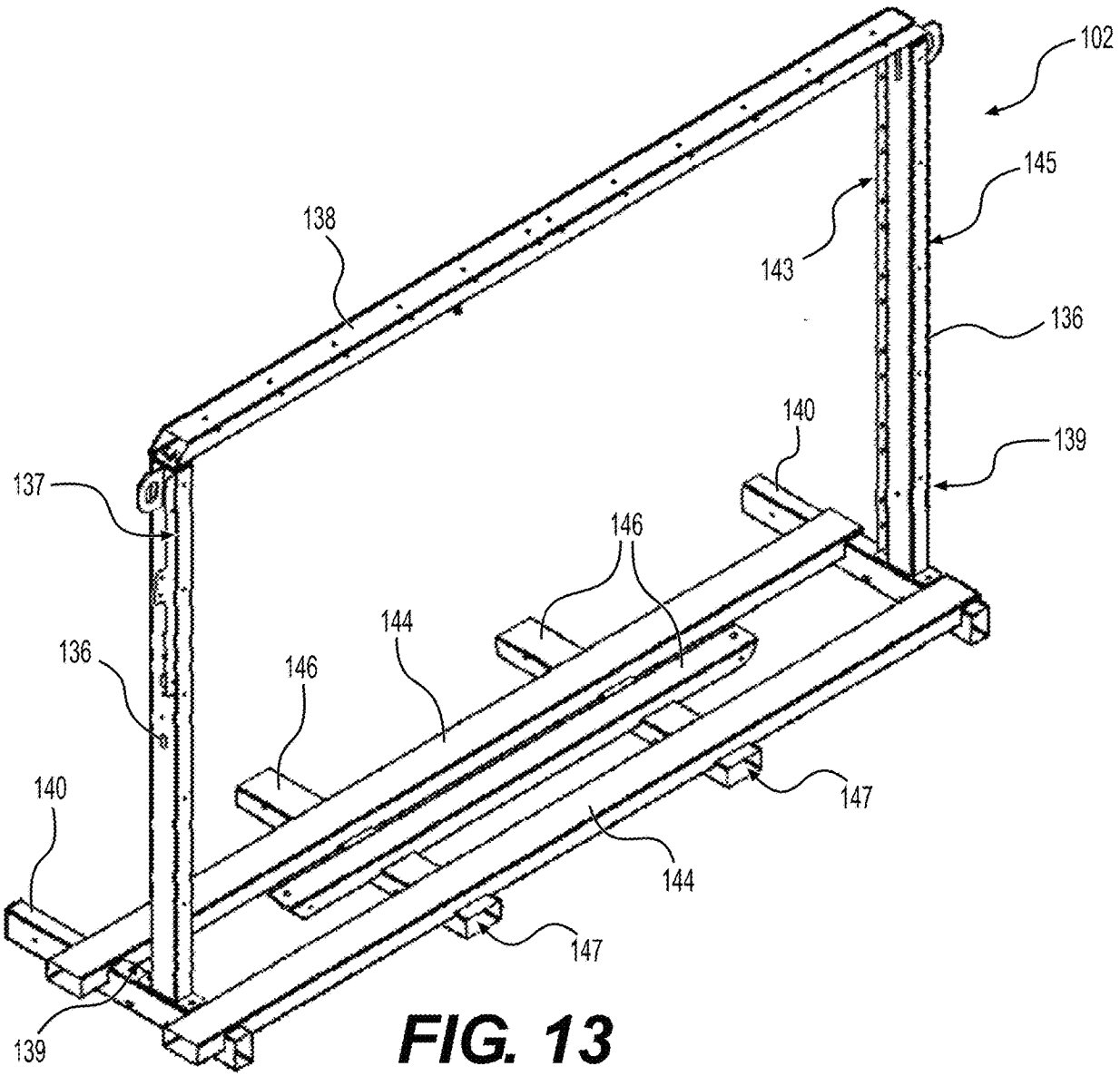
FIG. 13 is a perspective view, taken from the front, left side of a frame of the dry cooler assembly of FIG. 2.

As previously described, the frame 102 includes a lower portion 139 configured to be received by the channel 110 of the base member 106. The lower portion 139 of the frame 102 has at least one foot 140. With reference to FIG. 13, the frame 102 includes two feet 140 spaced apart from one another, with each foot 140 at either end of the frame 102. The foot 140 is sized to be received by the channel 110 in the assembled configuration. When the foot 140 is disposed in the channel 110, one end 142 of the foot 140 contacts the abutment member 124 (FIG. 14).

Each foot 140 is positioned transverse to a plane formed by the body portion 137 of the frame 102. As depicted in FIG. 13, the foot 140 is positioned orthogonal to the plane formed by the body portion 137 of the frame 102, such that each foot 140 extends away from an inner side 143 of the body portion 137. In some embodiments, the foot 140 also extends away from an outer side 145 of the body portion 137. At each end of the frame 102, the foot 140 is positioned beneath the upwardly extending arm 136. In certain embodiments, the upwardly extending arm 136 is disposed offset from the midpoint of the foot 140.

The channel 110 of each base member 106 receives one foot 140 from each frame 102. Specifically, one foot 140 from one frame 102 and one foot 140 from the other frame 102 are disposed in the channel 110 of each base member 106 such that the inner side 143 of each of the frames 102 face one another in the assembled configuration. Each end 142 of each foot 140 of the frame 102 abuts the abutment member 124, separating the two frames 102 in the spaced apart configuration when assembled. Each foot 140 may be secured to the base members 106 via fasteners such as screws. For example, each foot 140 may define openings aligned with openings defined in the corresponding base member 106 such that a screw may be inserted therein. In a specific example, the base member 106 includes openings 115 positioned along the channel walls 112 (as seen in FIGS. 9, 10, and 14) which align with openings disposed on the foot 140 and the screw may be inserted therein.

With reference to FIG. 13, the lower portion 139 of the frame 102 further includes at least one support member 144. The frame 102 includes two support members 144, each support member 144 extending between the two feet 140, providing a bottom surface for supporting the heat exchanger 12 and the cooling pad 16 and the reservoir 18 on either side of the frame 102. In certain embodiments, the support members 144 extend orthogonal to the feet 140 and parallel to the laterally extending arm 138. The support members 144 are positioned spaced apart from one another and laterally offset from the laterally extending arm 138. In other words, when viewed from the top, the laterally extending arm 138 is between the support members 144.

With reference to FIG. 14, in the assembled configuration, one of the support members 144 is received by one of the recessed portions 120 of the base member 106. The other support member 144 abuts an end of the base member 106. It is contemplated, in an alternative embodiment, that the base member 106 includes two recessed portions 120 disposed at each end region of the base member 106, such that each of the support members 144 are received by a complimentary recessed portion 120.

In an alternative embodiment, the support members 144 may not extend the entire distance between the two base members 106. For example, the support members 144 may extend from the foot 140 and terminate before a centerline of the frame 102. Similarly, the support members 144 may extend a distance away from the center point of the frame 102, terminating before the feet 140 of the frame 102. In a further alternative embodiment, the support members 144 may be omitted.

As depicted in FIG. 13, in certain embodiments, the lower portion 139 of the frame 102 may further include at least one additional support beam 146 configured to contact the surface and support a portion of the weight of the assembled dry cooler assembly 10. The frame 102 includes two support beams 146 positioned spaced apart from one another and orthogonal to the support members 144.

The frame 102 includes a receiving portion 147 for receiving a fork of a forklift. In some embodiments, the additional support beams 146 include the receiving portion 147. For example, the additional support beams 146 are hollow and form a slot 147 sized to receive the fork.

It is contemplated that any number of additional support beams 146 may be used and positioned in different configurations to provide support for the assembled dry cooler assembly 10. Further, it is contemplated that, in some embodiments, the additional support beams 146 may be omitted.

As depicted in FIG. 11, one of the support members 144 provides an attachment surface for the insert 132. In certain embodiments, the insert 132 is connected to the additional support beams 146. Specifically, the insert 132 is connected to a top surface of one, or both, of the support beams 146. It is contemplated that, in alternative embodiments, the insert 132 may be attached to any one of, or a combination of, the support members 144 and/or the additional support beams 146.

In some embodiments, the additional support beams 146 may provide an attachment surface for additional wire loop arrangements 126. For example, the cable and piping management systems 126 may include four wire loop arrangements 126. The four fixtures 128 may be positioned along the length of the assembled dry cooler assembly 10 and disposed underneath the insert 132. The first and last of the wire loop arrangements 126 may be connected to the base members 106, respectively, while the other two wire loop arrangements 126 may be attached to the additional support beams 146 of each of the frames 102. Alternatively, the additional wire loop arrangements 126 may be connected to one, or both, of the support members 144 or a combination of the support members 144 and the additional support beams 146.

All the components of the frame 102 are connectable to one another, forming a unitary piece. In some embodiments, the feet 140, the upwardly extending arms 136, the laterally extending arm 138, the support members 144, and the additional support beams 146 may be removably connected to one another using bolts or screws. In an alternative embodiment, the components may be secured to one another via welding. In a further alternative embodiment, the components may be secured to one another using a combination of fasteners, such as bolts, screws, and/or welding. Alternatively, the components may be formed integrally with one another.

Figure 15:
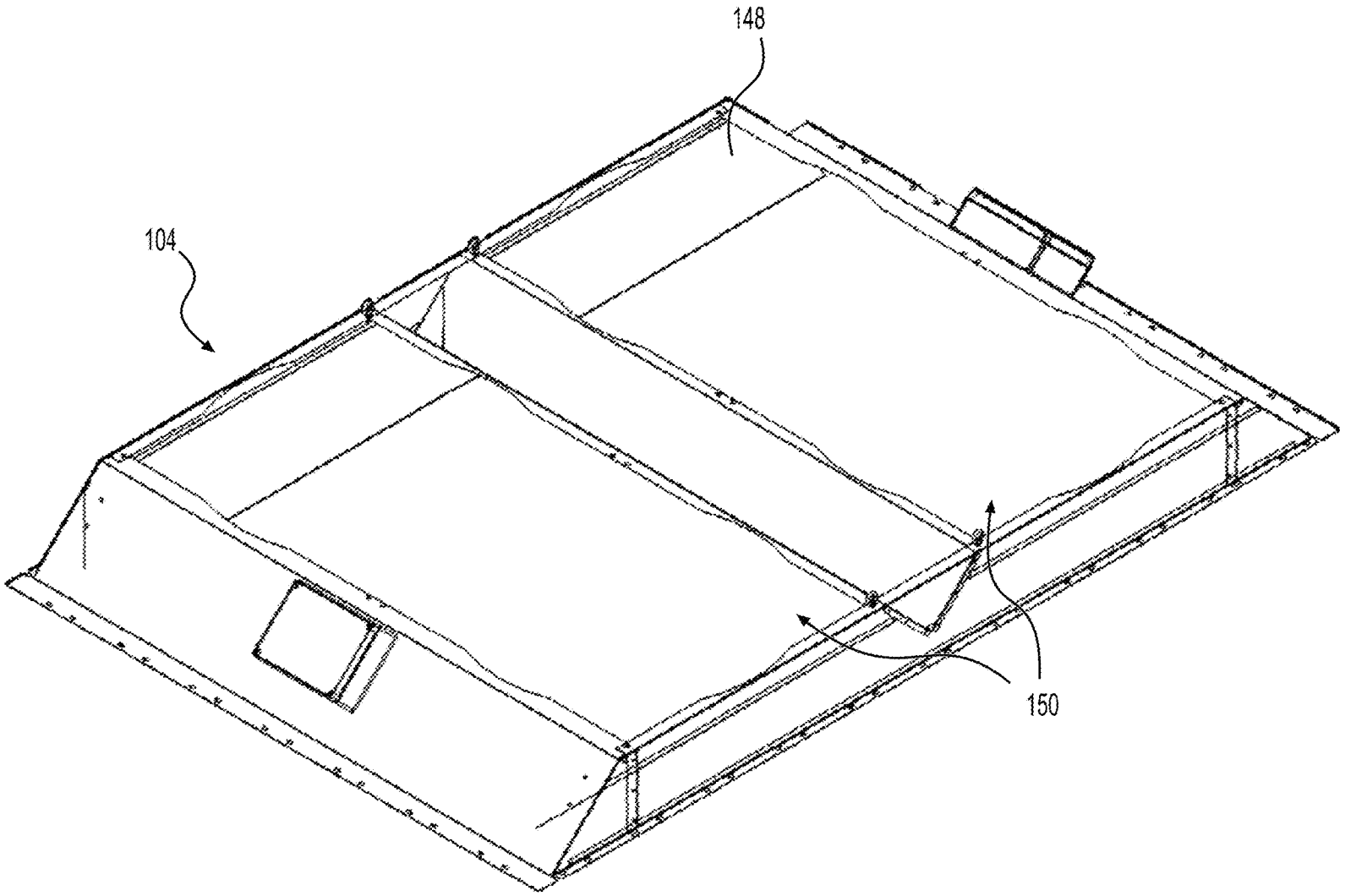
FIG. 15 is a perspective view, taken from the front, left side of a roof component of the dry cooler assembly of FIG. 2.
Figure 16:
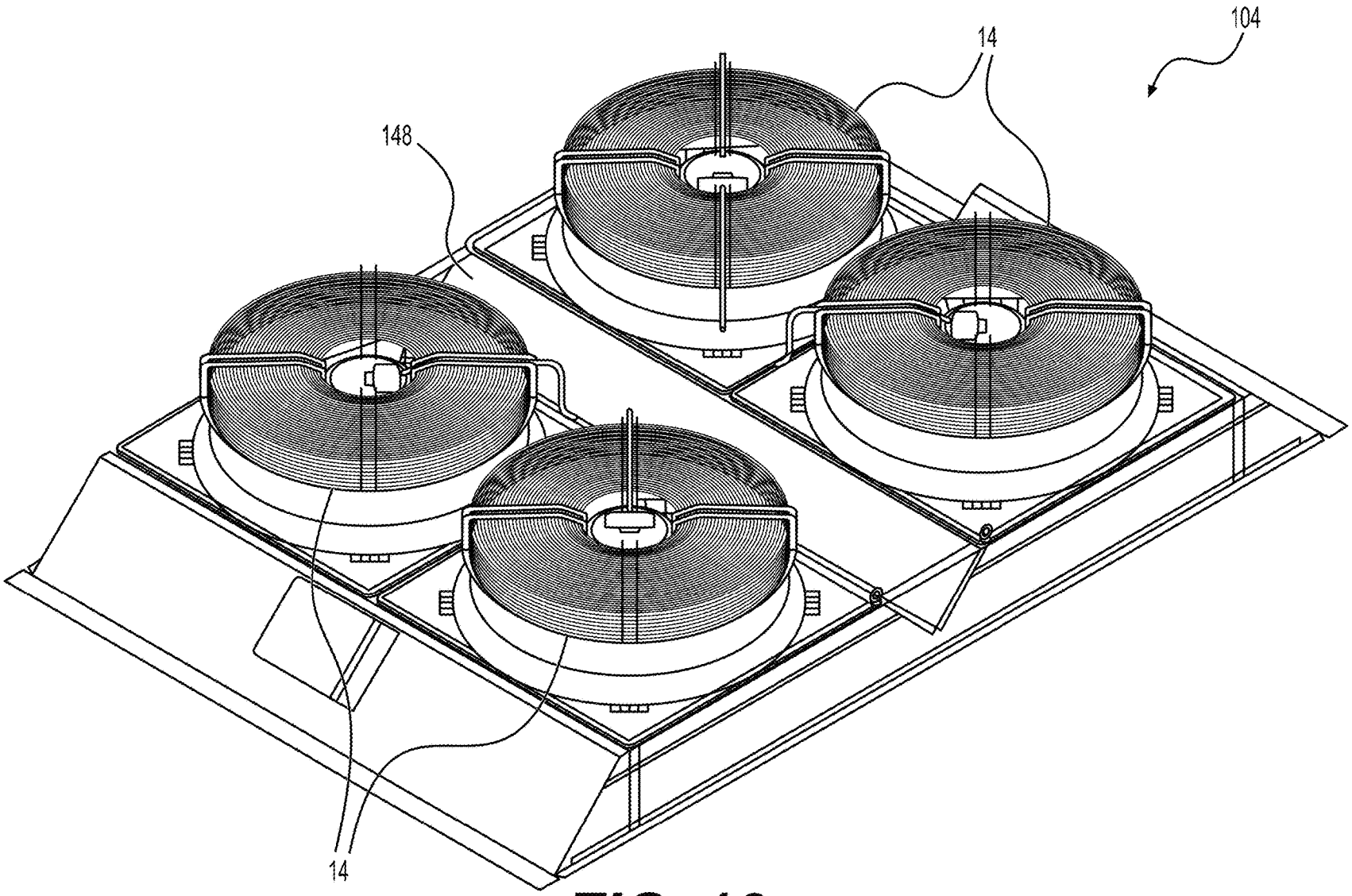
FIG. 16 is a perspective view, taken from the front, left side of the roof component of FIG. 15 and including fans disposed therewithin.
Figure 17:
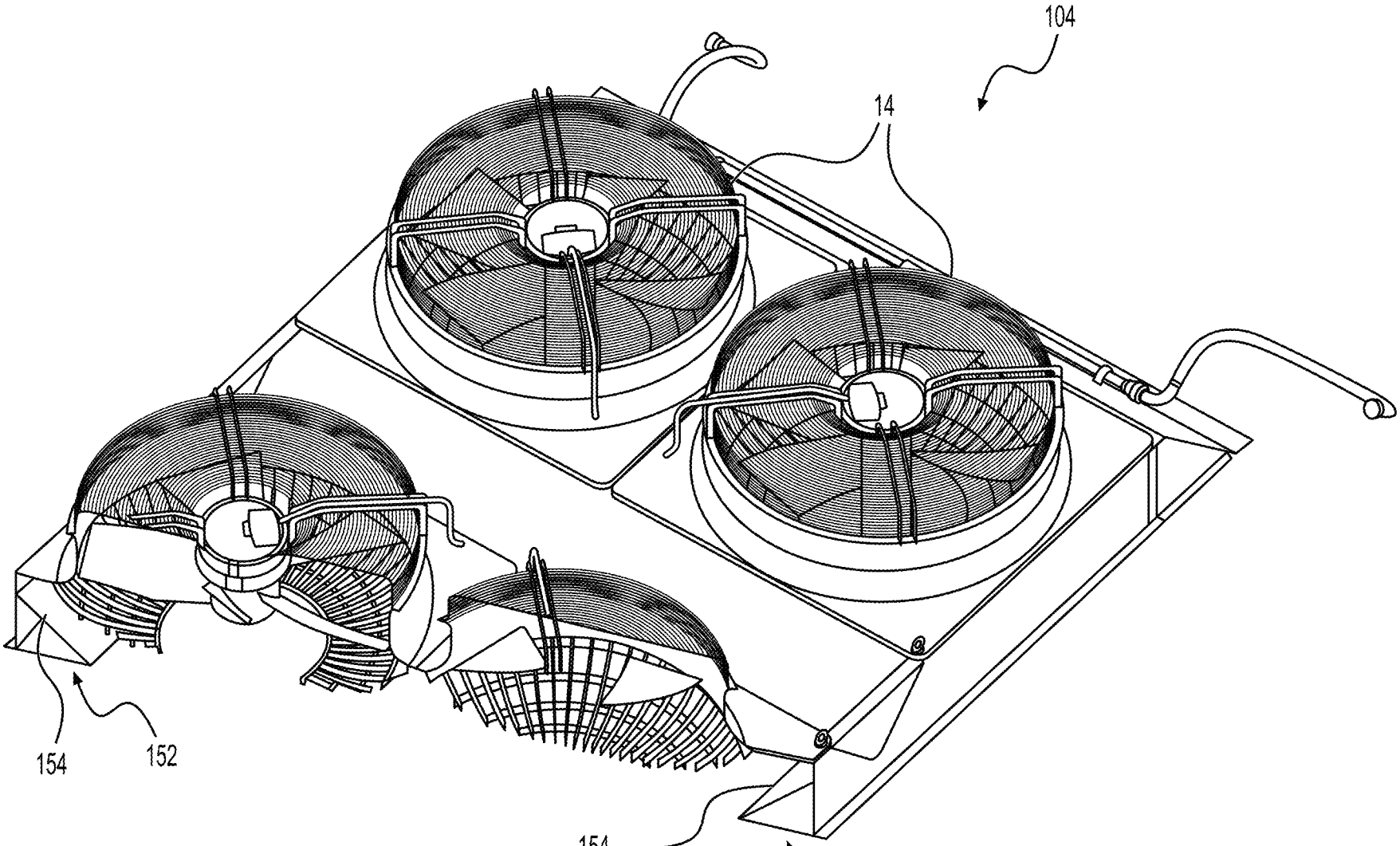
FIG. 17 is a perspective view, taken from the front, left side of the roof component of FIG. 15 and includes a cut-away portion, displaying a deflector therewithin.

With reference to FIGS. 15 to 17, the roof component 104 will now be described in further detail. The roof component 104 is configured to support the fans 14. The roof component 104 includes a panel 148 with openings 150 sized to receive at least one fan 14. In some embodiments, the panel 148 includes two openings 150, with each opening 150 sized to receive two fans 14. The fans 14 are disposed within the openings 150 and secured to the panel 148, as seen in FIG. 16. With reference to FIG. 17, in an alternative embodiment, the roof component 104 may further include a deflector 152 for guiding the air. The deflector 152 includes an angled portion 154 for directing the air towards the fans 14. The deflector 152 may be disposed on an interior portion of the roof component 104 and, in some embodiments, be positioned on opposing sidewalls of the roof component 104. The deflector 152 may be fastened to the roof component 104 via screws, bolts, etc. Alternatively, the deflector 152 may be integral with the roof component 104. However, it is appreciated the deflector 152 may include a different configuration. The roof component 104 is configured to removably secure to a top surface of the laterally extending arm 138 of each of the frames 102, such that the roof component 104 extends between the two frames 102 (see FIG. 11). In certain embodiments, the roof component 104 is sized to be substantially similar to, or smaller than, the body portion 137 of the frame 102. In an alternative embodiment, the roof component 104 may be secured in a different configuration, for example to an inner surface of the laterally extending arm 138 or to the upper portion of each of the upwardly extending arms 136, or a combination thereof.

It should be noted that although the dry cooler assembly 10 was described as having two frames 102, one roof component 104, and two base members 106, any number of these components may be used in alternative embodiments. For example, the dry cooler assembly 10 may include four base members 106. Thus, in the assembled configuration, each base member 106 is positioned spaced apart from one another and is configured to receive one foot 140 of a respective frame 102.

In another embodiment, the base members 106 may be configured to run parallel with the laterally extending arm 138 of the frame 102, rather than positioned orthogonal to the laterally extending arm 138 as previously described. In this embodiment, the feet 140 of the frame 102 are configured to extend parallel to the laterally extending arm 138 to be received by the channel 110 of the base member 106 in the assembled configuration.

It is further contemplated that the assembled dry cooler assembly 10 may be in a V-configuration. That is, frames 102 (and the heat exchangers 12, the cooling pads 16, and the reservoirs 18 connected to the frames 102) may be disposed at an angle, forming a V-shape.

The Method of Assembling the Dry Cooler Assembly

Figure 18:
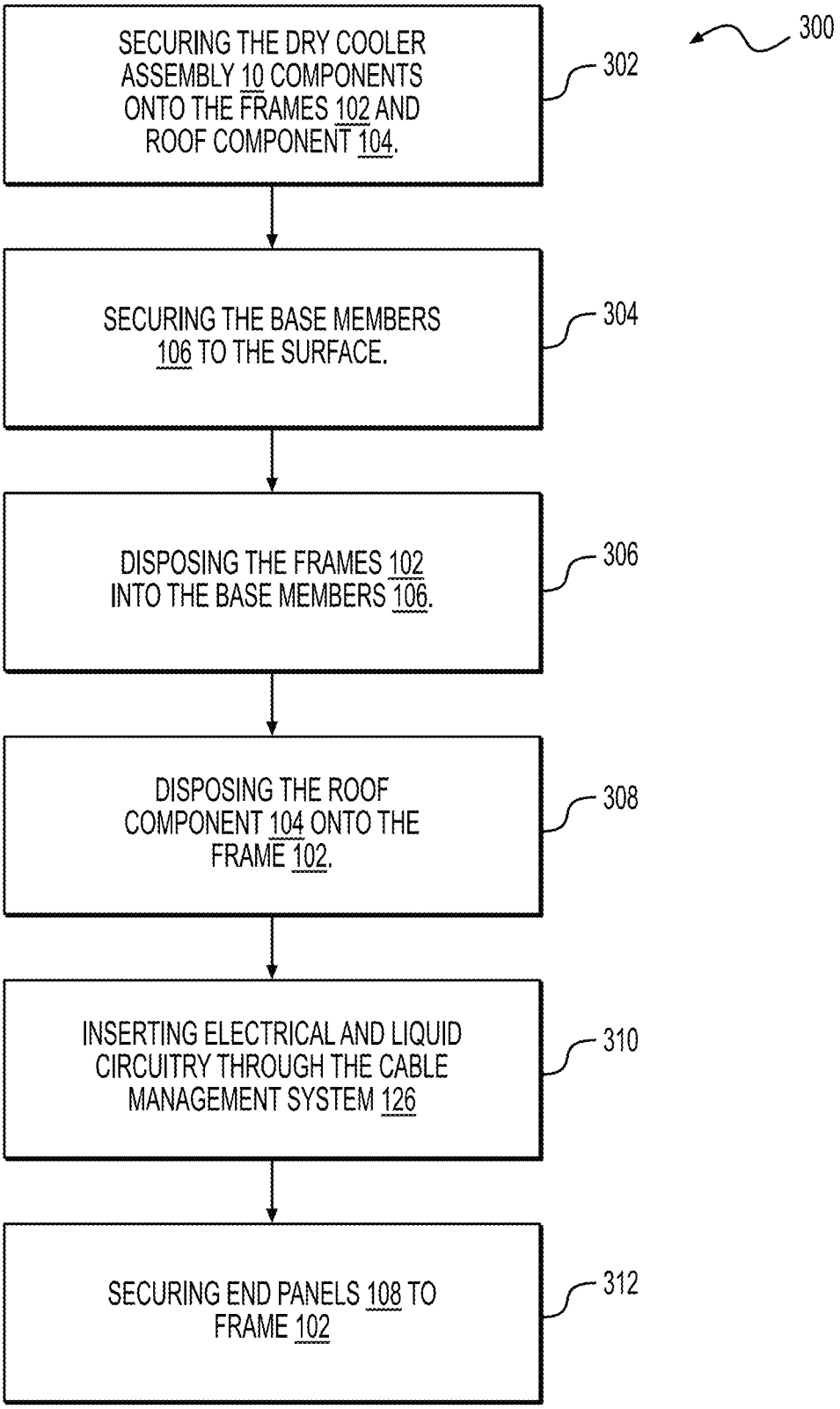
FIG. 18 is a flow chart of a method of assembling the dry cooler assembly of FIG. 1, according to embodiments of the present technology.

Referring to FIG. 18, a method 300 of assembling the dry cooler assembly 10 into the assembled configuration will now be described. Broadly, the method 300 of assembling the dry cooler assembly 10 includes securing the base members 106 to the support surface at which the dry cooler assembly 10 will be placed, positioning the two frames 102 into the base members 106, and disposing the roof component 104 onto the frames 102. The roof component 104 is provided already assembled with the fans 14, and the frames 102 are already assembled with the heat exchangers 12.

The method 300 includes step 304 of securing the base members 106 to the support surface on which the assembled dry cooler assembly 10 will be placed. Step 304 includes positioning the base members 106 such that the base members 106 are spaced apart from, and parallel to, one another. The base members 106 are spaced apart from one another at a distance substantially similar to the length of the laterally extending arm 138 of the frame 102. Step 304 further includes securing one base member 106 to the support surface by inserting bolts or screws into the openings 116 on the bottom face 114.

It is contemplated, in an alternative embodiment, that the base members 106 may be secured to the support surface using alternative means. For example, the base members 106 may be partially covered by concrete, thereby partially embedding the base members 106 into the support surface. Alternatively, a separate component (such as a brace) may be positioned across the base members 106 and secured to the support surface.

In some embodiments, one base member 106 is secured at a time. Alternatively, both base members 106 may be secured at the same time.

The method 300 further includes step 306 of disposing each of the frames 102 into the base members 106. Step 306 includes lifting one of the frames 102 and lowering the frame 102 into the base members 106. In certain embodiments, lifting the frame 102 includes inserting the fork of the forklift into the slot 147 of the support beams 146 and raising the frame 102. In an alternative embodiment, lifting the frame 102 is accomplished using a crane. In certain embodiments, lowering the frame 102 includes guiding the foot 140 of the frame into the channel 110 using the flared upper portions 118. That is, when lowering the frame 102, the feet 140 may contact a section of the flared upper portions 118 of the respective base member 106 and move downward along the angled wall into the channel 110. Step 306 may further include disposing the support members 144 into the recessed portions 120 of the respective base members 106. Step 306 may further include abutting the end 142 of the foot 140 against the abutment member of the respective base members 106. This process is repeated for the second frame 102.

It is contemplated, in an alternative embodiment, that the two frames 102 may be disposed in the base members 106 at the same time.

The method 300 further includes step 308 of disposing the roof component 104 onto the frame 102. Step 308 includes positioning the roof component 104 onto the upper surface of the laterally extending arm 138 of each of the frames 102, such that the roof component 104 extends between the two frames 102. Step 308 may further include connecting the roof component 104 to the frame 102. Connecting the roof component 104 to the frame 102 may include aligning openings of the roof component 104 with complimentary openings disposed on the laterally extending arm 138 and inserting screws or bolts into said openings.

In an alternative embodiment, the roof component 104 may be secured to another portion of the frame 102, such as the upper portion of the upwardly extending arms 136, or a combination of the upwardly extending arms 136 and the laterally extending arm 138.

It is contemplated that, in an alternative embodiment, the roof component 104 may be welded to the respective frame 102 component.

The method 300 may further include step 310 of inserting electrical and/or liquid circuity into the cable and piping management system. Step 310 may include inserting electrical and/or liquid circuitry into the loop wires 130 of the loop wire arrangement 126. In some embodiments, electrical and/or liquid circuitry may be inserted into a single loop wire arrangement 126 or multiple loop wire arrangements 126 disposed along the length of the dry cooler assembly 10. Step 310 may further include connecting the insert 132 to one of the support members 144 of each of the frames 102, forming the tunnel above the electrical and/or liquid circuitry. It is contemplated that connecting the insert 132 may be done prior to inserting electrical and/or liquid circuitry into the loop wire arrangement 126.

In some embodiments, step 310 may include inserting additional electrical and/or liquid circuitry for supporting multiple dry cooler assemblies 10, thereby enabling the addition of new dry cooler assemblies 10 in the future.

The method 300 may further include step 312 of positioning the end panels 108. In some embodiments, positioning the end panels 108 includes connecting one edge of the first end panel 108 to an outer surface of one of the upwardly extending arm 136 of the frame 102 and connecting the opposing edge of the end panel 108 to an outer surface of one of the upwardly extending arms 136 of the other frame 102. In some embodiments, connecting the respective edges of the end panel 108 to the respective upwardly extending arms 136 of the frames 102 includes aligning openings disposed on the end panel 108 to complimentary holes disposed on the upwardly extending arms 136 and inserting screws or bolts into said holes. In an alternative embodiment, the end panel 108 may be welded to the frame 102. The process is repeated for the second end panel 108.

In an alternative embodiment, connecting the end panel 108 may further include connecting an upper edge of the end panel 108 to one edge of the roof component 104 and/or connecting a lower edge of the end panel 108 to one of the base members 106. It is contemplated, that the end panels 108 may be connected one after another or at the same time.

Optionally, the method 300 may include step 302 for when the dry cooler assembly 10 components are not connected to the respective frame 102 and/or roof component 104. Thus, the optional step 302 includes assembling one or more of the dry cooler assembly 10 components onto their respective frames 102 and the roof component 104. In some embodiments, step 302 includes connecting one of the heat exchangers 12 to the inner side of the body portion 137 of one of the frames 102. Step 302 may further include connecting one of the cooling pads 16 and one of the reservoirs 18 to the outer side of the body portion 137 of the respective frame 102. Thus, sandwiching the frame 102 between the heat exchanger 12 and the cooling pad 16 and associated reservoir 18. In some embodiments, connecting the heat exchanger 12, the cooling pad 16, and the reservoir 18 to the respective frame 102 includes aligning openings disposed on the heat exchanger 12, the cooling pad 16, and the reservoir 18 with complimentary openings disposed on the upwardly extending arms 136 and the laterally extending arm 138 of the frames 102 and inserting a connector such as a bolt or a screw into said openings. This process is repeated for the second frame 102.

In an alternative embodiment, the heat exchanger 12, the cooling pad 16, and the reservoir 18, may be connected to another portion of the frame 102. For example, the reservoir 18 may be connected to one of the support members 144 of the frame 102. In a further alternative embodiment, the heat exchanger 12, the cooling pad 16, and the reservoir 18 may be welded to the respective frame 102 components.

The optional step 302 further includes disposing the fans 14 into the openings 150 of the roof component 140 and connecting the fans 14 to the panel 148 of the roof component. In some embodiments, connecting the fans 14 to the panel 148 involves aligning complimentary holes disposed on the fans 14 and the panel 148 and inserting screws or bolts into the complimentary holes.

In an alternative embodiment, the fans 14 may be welded to the panel 148 of the roof component.

Due to the modularity of the dry cooler assembly 10, it is appreciated that the method 300 described above is exemplary and that steps 302 to 312 are interchangeable and may be performed in an alternative order. For example, step 312 of securing the end panels 108 to the frame 102 may be performed prior to step 308 of disposing the roof component 104 onto the frame 102. In another example, step 310 of inserting electrical and/or liquid circuitry into the cable and piping management system may be done prior to step 308 of disposing the roof component 104 onto the frame 102.

It is further appreciated that method 300 includes steps of connecting the electrical circuitry to a power source and the liquid circuitry to the datacenter and datacenter reservoir. It is contemplated that method 300 may include additional steps of connecting the reservoir 18 to the cooling pad 16.

The disclosed embodiments of the dry cooler assembly 10 provide various benefits. Specifically, the modular design of the dry cooler assembly 10 provides the dry cooler assembly 10 to be modulated between a disassembled configuration and an assembled configuration, where the disassembled configuration reduces the footprint compared to that of the assembled configuration. As a result, storage and shipment of the dry cooler assembly 10 are improved. Regarding shipment of the dry cooler assembly 10, multiple dry cooler assembles 10 in the disassembled configuration may be housed within a single shipping container, thereby reducing shipment costs and the size of the carbon footprint. Further, the modular nature of the dry cooler assembly 10 provides flexibility during installation. Additionally, as each component of the dry cooler assembly 10 is separate, machinery required may be reduced as the weight of each component is less than the entire weight of the dry cooler assembly 10. Additionally, the dry cooler assembly 10 removes the need for complicated assembly steps, such as the requirement of installing complicated concrete supports. Furthermore, due to the modular design, new dry cooler assemblies 10 may be easily installed.

In view of the various disclosures directed to a dry cooler assembly 10, it will be understood that, although the embodiments presented herein have been described with reference to specific features and structures, it is clear that various modifications and combinations may be made without departing from such disclosures. The specification and drawings are, accordingly, to be regarded simply as an illustration of the discussed implementations or embodiments and their principles as defined by the appended claims, and are contemplated to cover any and all modifications, variations, combinations or equivalents that fall within the scope of the present disclosure.

What is claimed is:

1. A kit for a dry cooler assembly, the kit comprising:

a first frame and a second frame, each of the first and the second frames being configured to support a heat exchanger and having a body portion and a lower portion, the body portion of each of the first and second frames having an inner side and the lower portion of each of the first and second frames having a first foot and a second foot that are spaced apart from each other and extending away from the inner side of the body portions;

a base component comprising a first base member and a second base member, each of the first and second base members incorporating an elongate body having a channel defined therein that is defined by channel walls having functional surfaces configured to receive the respective lower portion of each of the first and the second frames; and a roof component;

wherein the channel of each of the first and second base members is configured to receive one of the first foot and the second foot of the first frame and the other of the first foot and the second foot of the second frame, such that the inner sides of the first and second frames face one another in the assembled configuration, and wherein the first and the second frames, the base component, and the roof component are configured to be assembled to an assembled configuration, such that the base component supports the first and the second frames in a spaced apart configuration, and the first and the second frames are located below the roof component.

2. The kit of claim 1, wherein at least one of the channel walls has a flared upper portion.

3. The kit of claim 1, wherein the lower portion comprises a support member, and the channel walls further comprise a recessed portion for receiving the support member, the support member extending in a different direction to the first foot and the second foot.

4. The kit of claim 1, wherein the elongate body further comprises an abutment member configured such that at least one of the first foot and the second foot abuts the abutment member in the assembled configuration.

5. The kit of claim 1, further comprising a cable and piping management system, the cable and piping management system comprising: an insert positionable between the first and second frames and shaped to create a tunnel between the respective inner sides of the first and second frames.

6. The kit of claim 5, wherein the cable and piping management system further comprises a loop wire arrangement connectable to at least one of the base component, the first frame and the second frame.

7. The kit of claim 1, wherein the kit further comprises a shipping container housing the first and the second frames, the base component and the roof component, the first and the second frames, the base component and the roof component forming one set of the dry cooler assembly.

8. The kit of claim 7, wherein within the shipping container, the roof component is disposed in between the first and the second frames.

9. The kit of claim 7, wherein the roof component is configured to be removably coupled to at least one of the first and the second frames when positioned in the shipping container housing.

10. The kit of claim 9, wherein:

the roof component comprises at least one opening configured to align with at least one opening on at least one of the first and the second frame; and, the roof component being removably coupled to at least one of the first and the second frame via insertion of at least one fastener extending through the aligned openings of the roof component and at least one of the first and the second frame.

11. The kit of claim 7, wherein the shipping container houses a plurality of the sets of the dry cooler assembly.

12. The kit of claim 1, wherein the roof component is sized to accommodate the first and the second vertical frames.

* * * * *